US010145111B2

(12) United States Patent
Weber

(10) Patent No.: US 10,145,111 B2
(45) Date of Patent: Dec. 4, 2018

(54) HEADER AND JAMB KIT PROVIDING ROUGH OPENING FOR HOLLOW METAL DOOR FRAME IN STEEL STUD CONSTRUCTION

(71) Applicant: Robert Weber, Bohemia, NY (US)

(72) Inventor: Robert Weber, Bohemia, NY (US)

( * ) Notice: Subject to any disclaimer, the term of this patent is extended or adjusted under 35 U.S.C. 154(b) by 0 days.

(21) Appl. No.: 15/252,329

(22) Filed: Aug. 31, 2016

(65) Prior Publication Data

US 2017/0073970 A1 Mar. 16, 2017

Related U.S. Application Data

(60) Provisional application No. 62/216,497, filed on Sep. 10, 2015.

(51) Int. Cl.

| | |
|---|---|
| ***E04C 3/02*** | (2006.01) |
| ***E04C 3/04*** | (2006.01) |
| ***E06B 1/14*** | (2006.01) |
| ***E06B 1/52*** | (2006.01) |
| ***E06B 1/70*** | (2006.01) |

(Continued)

(52) U.S. Cl.

CPC ..... *E04C 3/04* (2013.01); *E04B 2/7457* (2013.01); *E04B 2/766* (2013.01); *E04C 3/02* (2013.01); *E06B 1/14* (2013.01); *E06B 1/52* (2013.01); *E06B 1/70* (2013.01); *E04B 2/789* (2013.01); *E04B 2002/7488* (2013.01); *E04C 2003/023* (2013.01); *E04C 2003/0473* (2013.01)

(58) Field of Classification Search

CPC ..... E04C 3/04; E04C 3/02; E04C 2003/0473; E04C 2003/023; E04B 2/7457; E04B 2/766; E04B 2002/7488; E04B 2/789; E06B 1/70; E06B 1/14; E06B 1/52

USPC ..... 52/204.2, 204.1, 236.3

See application file for complete search history.

(56) References Cited

U.S. PATENT DOCUMENTS

| | | | |
|---|---|---|---|
| 963,938 | A | 7/1910 | Phillips |
| 2,177,277 | A | 10/1939 | Burke |

(Continued)

OTHER PUBLICATIONS

Marino Ware, Cold Formed Structural Framing Systems, Jul. 2014, pp. 24, 39, and 53, available at: http://www.marinoware.com/documents/cfsstructural-catalog.pdf.

(Continued)

*Primary Examiner* — Basil S Katcheves

(74) *Attorney, Agent, or Firm* — Thomas A. O'Rourke; Budner & O'Rourke, LLP

(57) ABSTRACT

A pre-formed header assembly creates a rough wall opening for a metal door/frame, permitting completion of electrical, ducting, drywall, etc. prior to receiving/installing the door frame. The header is secured to first and second king studs at respective locations positioned beyond a desired door frame location. The header includes four different channels, one of which is utilized at two locations. The first channel has a first length to span between the king studs. The second channel has a second length, and the third channel a third length, which correspond to minimum dimensional requirements for completing the wall. The base of the second and third channels are each fixedly secured to the base of the first channel. The base of the fourth and fifth channels are fixedly secured to the first and second ends of the base of the first channel, respectively, substantially perpendicular thereto, for attachment to the king studs.

10 Claims, 20 Drawing Sheets

(51) Int. Cl.

| | |
|---|---|
| ***E04B 2/74*** | (2006.01) |
| ***E04B 2/76*** | (2006.01) |
| *E04B 2/78* | (2006.01) |

(56) References Cited

U.S. PATENT DOCUMENTS

| | | | | | |
|---|---|---|---|---|---|
| 2,316,425 | A | | 4/1943 | Hasenburger | |
| 2,619,687 | A | | 12/1952 | Kahn | |
| 3,436,886 | A | | 4/1969 | Nowak | |
| 3,536,345 | A | | 10/1970 | Leifer | |
| 4,055,916 | A | | 11/1977 | Yamamoto | |
| 4,067,157 | A | | 1/1978 | Robinson | |
| 4,085,966 | A | | 4/1978 | Ringe | |
| 5,218,803 | A | | 6/1993 | Wright | |
| 5,689,922 | A | * | 11/1997 | Daudet | E04B 2/58 52/204.1 |
| 5,802,782 | A | | 9/1998 | Jewell | |
| 6,216,400 | B1 | | 4/2001 | Helton | |
| 6,401,405 | B1 | | 6/2002 | Hicks | |
| 7,210,271 | B2 | | 5/2007 | Wheeler | |
| 7,383,665 | B2 | * | 6/2008 | Frobosilo | E04B 2/58 52/204.2 |
| 7,716,899 | B2 | * | 5/2010 | Beck | E04B 1/24 52/236.3 |
| 7,891,155 | B2 | | 2/2011 | Surowiecki | |
| 8,387,322 | B2 | | 3/2013 | George | |
| 8,615,942 | B2 | * | 12/2013 | Lafreniere | E04B 2/766 52/204.2 |
| 2006/0096192 | A1 | * | 5/2006 | Daudet | E04B 1/24 52/204.1 |
| 2006/0096201 | A1 | * | 5/2006 | Daudet | E04B 1/24 52/272 |

OTHER PUBLICATIONS

Clark Dietrich, Preformed L-Header That Slides Into Place Quickly, Jul. 22, 2015, available at: www.clarkdietrich.com/products/door-window-framing-systems/l-header.

Clark Dietrich, RedHeader RO, Jul. 22, 2015, available at: www.clarkdietrich.com/products/door-window-framing-systems/redheader-ro-rough-opening-system.

Clark Dietrich, TradeReady Header, Jul. 22, 2015, available at: www.clarkdietrich.com/products/door-window-framing-systems/tradeready-header.

* cited by examiner (Completed Rough Opening for Hollow Door Frame using the Spreader Header of the Present Invention)

(Electrical and Ductwork Installed across Rough Opening)

(Sheet-rocked Wall Prior to Hollow Door Frame Instl.)

(Hollow Metal Door Frame and two loose studs)

(Hollow Metal Door Frame with Jamb Stud Fastened to Anchors on each side)

(Precut Drywall Piece)

(Precut Drywall Piece)

(Precut Drywall Pieces Installed over Studs)

(Spreader Header Installed at an Inside Corner Wall)

HEADER AND JAMB KIT PROVIDING ROUGH OPENING FOR HOLLOW METAL DOOR FRAME IN STEEL STUD CONSTRUCTION

CROSS REFERENCES TO RELATED APPLICATIONS

This application claims priority on U.S. Provisional Application Ser. No. 62/216,497, filed on Sep. 10, 2015, the disclosures of which are incorporated herein by reference.

FIELD OF THE INVENTION

The present invention relates to the field of building components and construction, and is particularly directed to a new header and track/jamb system and method for constructing a door framing arrangement using metal studs.

BACKGROUND OF THE INVENTION

While the use of metal (steel) studs for framing in residential construction has continued to grow, its use in commercial and industrial buildings has been prevalent for decades. Such use is shown in the prior art by, for example, U.S. Pat. No. 963,938 to Phillips for "Metallic Stud or Furring Strip"; U.S. Pat. No. 2,177,277 to Burke for a "Metal Stud"; and U.S. Pat. No. 3,536,345 to Leifer for "Track for Steel Stud Partitions."

Steel stud framing offers many advantages over conventional wood framing, such as: ease of installation due to accurate pre-cutting by the manufacturer, which eliminates sawing and waste at the job site; resistance to termites, mold, fungus, and fire; resilience with age unlike a wood structure, which may be susceptible to rot, particularly in moist climates, thus steel framing has a longer life span; and steel stud construction may also have less of an impact on the environment, with respect to deforestation, because while its production may be energy-intensive, much of the building components for such construction make use of recycled steel. Steel is the most recycled material in the United States, with an estimated 50-55 million tons of steel being recycled in 2015 alone.

As a result of such benefits from the use of steel instead of timber for framing, many advantageous techniques and short-cuts have been devised, and appear in the art. For example, U.S. Pat. No. 5,218,803 to Wright teaches a "Method and Means for Reinforcing a Steel Stud Wall."

However, a problem nonetheless persists with the progression of steel stud construction occurring in a timely manner, with respect to completing installation of a door header and the duct work above it, as well as electrical, sheet rock, and moldings that follow installation of the hollow metal door frame. It is a frequent occurrence in building construction to experience late delivery of the hollow metal door frames, and it often has a significant impact on a contractor's ability to meet scheduled completion dates. The present invention is directed to a novel header configuration and a method of wall construction that circumvents the delays caused by the late delivery of hollow metal door frames. The novel header disclosed herein may also be utilized to accommodate framing of a wall in the corner of a room, adjacent to an intersecting wall, for close placement of the new wall to the corner, and thus may provide dual functionality.

OBJECTS OF THE INVENTION

It is an object of the present invention to provide a method of constructing a steel stud wall with a rough opening that eliminates exposed jamb track ends, prior to receiving and installing of the hollow metal door frame, to prevent damage thereto, and to improve worker safety.

It is another object of the present invention to provide a method of constructing a steel stud wall, without installation and use of the required hollow door fame, until well after finish construction details have been completed around the door opening, including electrical wiring, duct work, sheet rock, moldings, etc.

It is a further object of the invention to provide a formed header configuration that may be fastened to stud members at locations beyond the design location of a hollow metal door frame.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In accordance with at least one embodiment of the present invention, a pre-formed header assembly may be used in creating a rough opening for a metal door frame in a wall, which permits completion of the wall structure and systems installations (e.g., electrical, ducting, drywall, moldings, etc.), prior to receiving and installing of the hollow metal door frame. The preformed header may also create a rough opening that eliminates exposed jamb track ends, to prevent damage thereto, and thereby improve worker safety.

The pre-formed header may be configured to be secured to a first king stud and to a second king stud at respective king stud locations positioned beyond a desired location for the metal door frame. The pre-formed header may include four different channel members, one of which may be utilized at two different locations on the header.

A first channel member may have a first end and a second end, formed with a first length between the first and second ends. The first channel may be formed with an elongated base and a pair of flanges extending laterally from opposite sides thereof to form a U-shaped cross-section. The second channel member may be similarly formed, and may have a first end and a second end, having a second length between the first and second ends. The second channel may also be formed of an elongated base and a pair of flanges extending laterally from opposite sides thereof to form a U-shaped cross-section. The base of the second channel member may be fixedly secured to the base of the first channel member, for the first end of the second channel member to be proximate to the first end of the second channel member, so that the respective pair of flanges are substantially aligned. Where the ends of the channels are formed to be planar, the bases of each of the channels may be secured together such the first ends are substantially coplanar. The third channel member may have a first end and a second end, formed with a third length between the first and second ends. The third channel may also be formed with an elongated base and a pair of flanges extending laterally from opposite sides thereof to form a U-shaped cross-section. The base of the third channel member may be fixedly secured to the base of the first channel member, for the second end of the third channel member to be proximate to, or substantially coplanar with, the second end of the first channel member, with the respective pair of flanges to be substantially aligned. The fourth channel member may also be formed with a base and a pair of flanges extending laterally from opposite sides thereof to form a U-shaped cross-section. The base of the fourth channel member may be fixedly secured to the base of the first channel member to be substantially perpendicular thereto, for the flanges of the fourth channel member to be displaced from, but substantially aligned with, the flanges of the second channel member. The fifth channel may be formed substantially the same as the fourth channel member. The base of the fifth channel member may be fixedly secured to the base of the first channel member to be substantially perpendicular thereto, for the flanges of the fifth channel member to be displaced from, and substantially aligned with, the flanges of the third channel member. The distance between the base of the fourth channel member and the base of the fifth channel member may be particularly configured to permit the respective pair of flanges thereof to mount to, and be secured to, the first king stud and the second king stud that may be selectively spaced apart for a particular door and corresponding metal door frame size.

For example, for a 36 inch metal door which typically has a 40 inch door frame, the king studs may be spaced apart roughly 55⅛ inches, and the length of the first channel may be just slightly less than 55⅛ inches. For a 48 inch door and frame, or for a 52 inch door and frame, the spacing between the king studs may be correspondingly increased, as well as the length of the first channel section.

The second length for the second channel member may be configured to provide a minimum length required to position the metal door frame in close proximity with an intersecting wall. The third length for the third channel member may be configured to provide a minimum amount of space required for an electrical box, once jack studs are received and secured to the third channel member.

Once the header is secured to the first and second king studs, at the proper height above the floor (e.g., 85½ inches for a standard height door and frame), the rest of the construction on the wall may proceed, without the metal door frame being installed, which installation may occur when it arrives onsite. Once the metal door frame and door arrive, the rough opening may be prepped for its installation.

To finish the rough opening a first lower channel, which may have a length substantially equal to the second length of the second channel member, may be secured to the floor, to have a first end thereof adjacent to the first king stud, and to extend toward a center of the rough opening. The upwardly disposed flanges of the first lower channel may thus be substantially aligned with the downwardly disposed flanges of the second channel member.

Also, a second lower channel, which may have a length substantially equal to the third length of the third channel member, may be secured to the floor, to have a second end thereof positioned adjacent to the second king stud, and to extend toward a center of the rough opening. The upwardly disposed flanges of the second lower channel may thus be substantially aligned with the downwardly disposed flanges of the third channel member.

Thereafter, the bottom end of a first jack stud may be received in the first lower channel section, with its upper end received within the second channel, for the first jack stud to be adjacent to the first king stud. The first jack stud may then be fixedly secured to the first lower channel section and to the second channel. Similarly, a bottom end of a second jack stud may be received in the second lower channel, and an upper end thereof received in the third channel section, for the second jack stud to be positioned a distance away from a second end of the second lower channel being equal to a width of the jack stud. Next the metal door/frame may be prepped, by respectively securing third and fourth jack studs to first and second sides of the metal door frame.

The metal door frame with the third and fourth jack studs secured thereto may then be installed in the rough opening. The metal door frame with the third and fourth jack studs may be angled so that the top of the third jack stud may be received in the second channel member, while the top of the fourth jack stud is received in the third channel member. The bottom of the metal door frame with the jack studs may be swung to be plumb, and may then lowered for the bottom of the third jack stud to be received in the first lower channel section, and the bottom of the fourth jack stud to be received in the second lower channel section. Next, the top and bottom of the third jack stud may be fixedly secured to the second channel member and the first channel section respectively; and the top and bottom of the fourth jack stud may be fixedly secured to the third channel member and the second channel section respectively. Preformed drywall sections may be secured over the jack studs, and may be suitably finished (e.g., taped, mudded, painted, etc.).

DETAILED DESCRIPTION OF THE INVENTION

As used throughout this specification, the word "may" is used in a permissive sense (i.e., meaning having the potential to), rather than the mandatory sense (i.e., meaning must). Similarly, the words "include", "including", and "includes" as used herein mean including but not limited to.

The phrases "at least one", "one or more", and "and/or" are open-ended expressions that are both conjunctive and disjunctive in operation. For example, each of the expressions "at least one of A, B and C", "one or more of A, B, and C", and "A, B, and/or C" mean all of the following possible combinations: A alone; or B alone; or C alone; or A and B together; or A and C together; or B and C together; or A, B and C together.

Also, all references (e.g., patents, published patent applications, and non-patent literature) that are cited within this documents are incorporated herein in their entirety by reference.

Furthermore, the described features, advantages, and characteristics of any particular embodiment disclosed herein, may be combined in any suitable manner with any of the other embodiments disclosed herein.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

Figure 1:
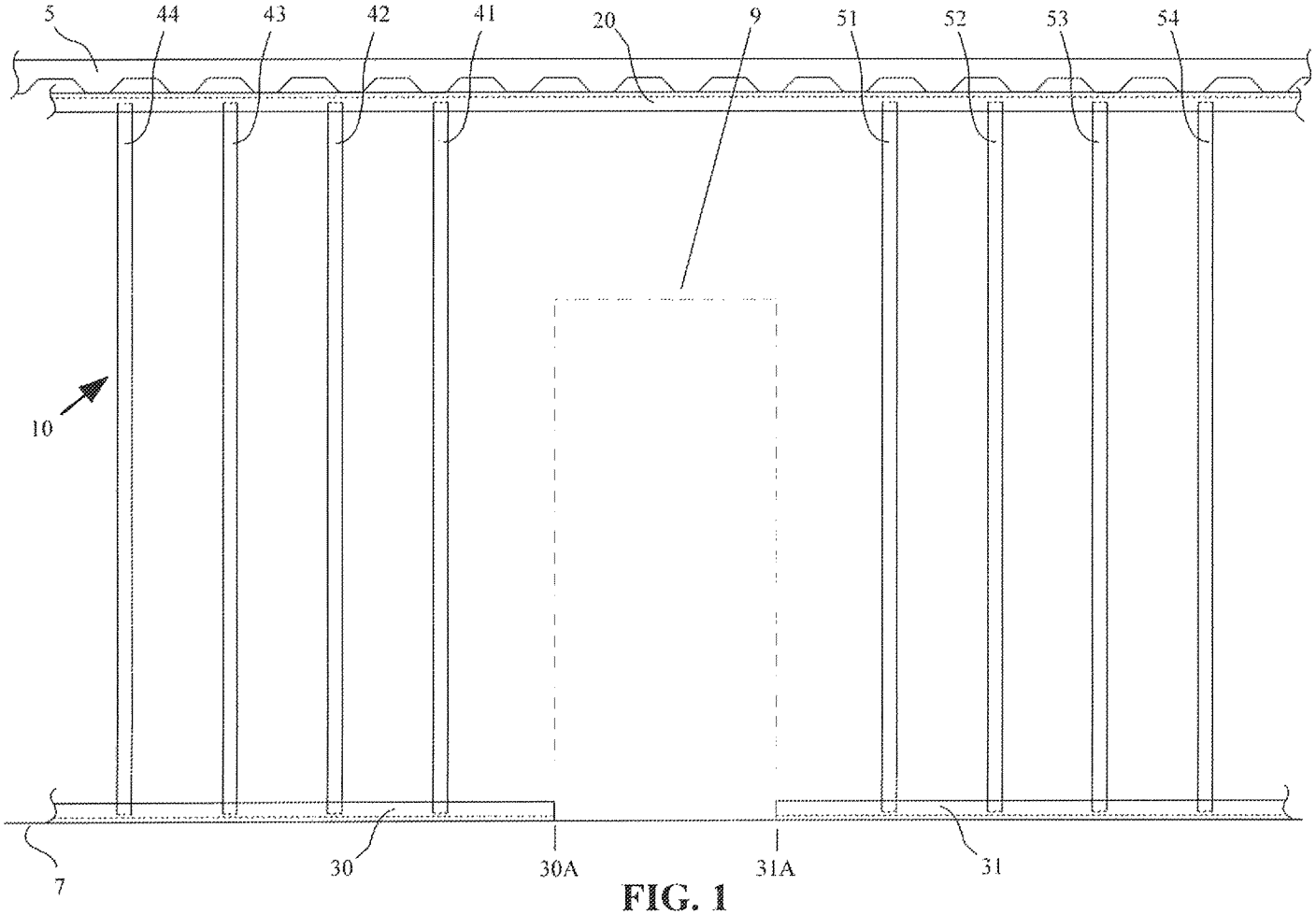
FIG. 1 (Prior Art)
FIG. 1 discloses a prior art steel stud framed wall, prior to installation of: the hollow metal door frame, the king studs, the header, and the cripple studs.

In the prior art construction of a wall 10 of a building utilizing steel studs and an upper and lower track for the top plate and bottom plate, the same sequence of steps is commonly used. As seen in FIG. 1, after the desired location for the wall has been properly measured and marked, the upper track 20 may be secured to the metal deck and concrete slab 5, and two lower tracks may be secured to the floor 7. A first lower track 30 may be cut to the proper length, and may be secured to the floor, such that its end 30A may be located at the point at which a steel stud may be later positioned/secured to support a first side of a hollow metal door frame, for the desired door opening 9. A second lower track 31 may similarly be cut to the proper length, and may also be secured to the floor, such that its end 31A may be located at the point at which a second steel stud may be later positioned/secured to support a second side of the hollow metal door frame. Although other door sizes may be accommodated, as discussed hereinafter, this prior art description, and the subsequently described exemplary embodiment(s) of the present invention, are each discussed with respect to installation of a hollow metal door frame for hanging a 36 inch door.

Figure 2:
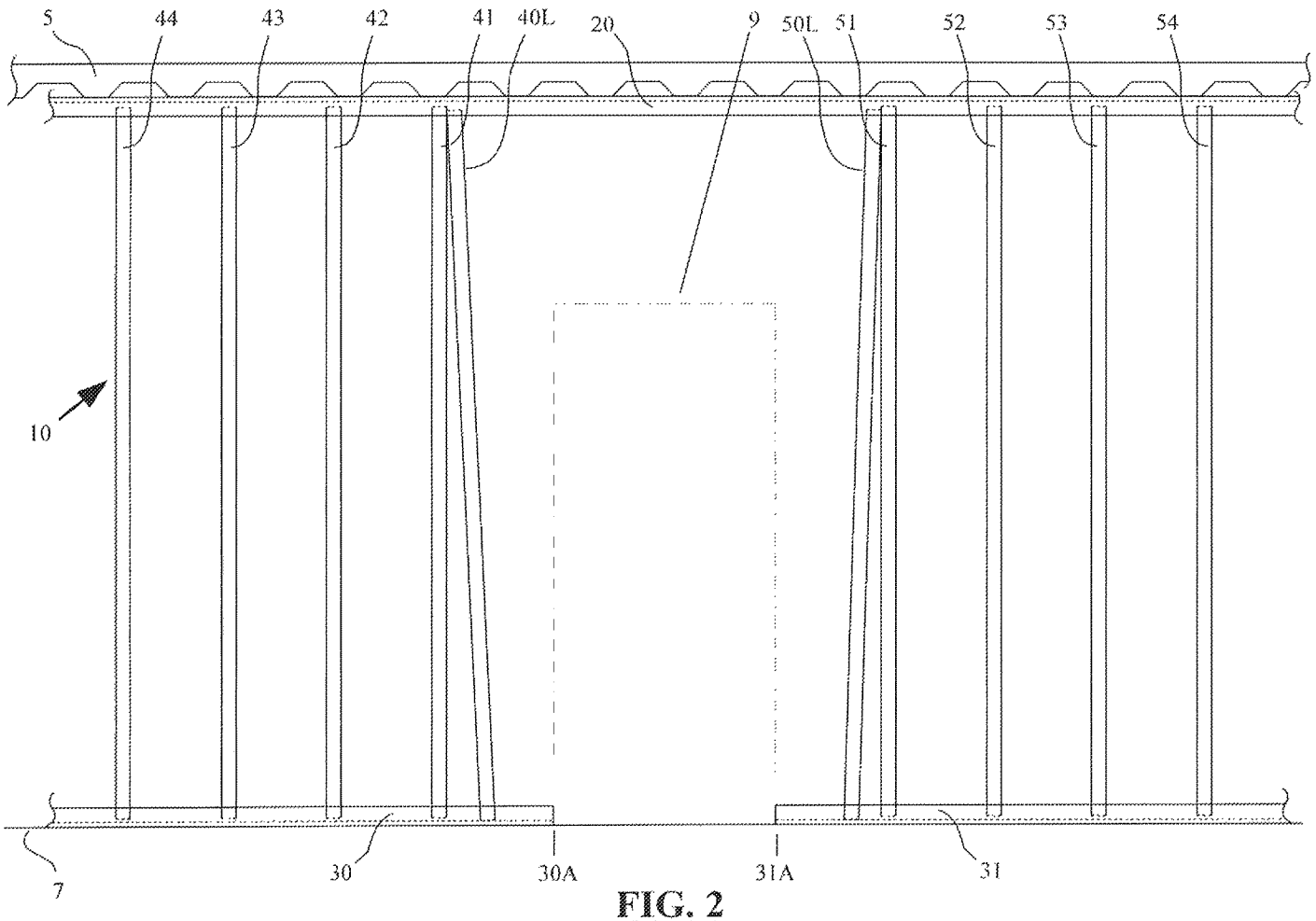
FIG. 2 (Prior Art)
FIG. 2 illustrates the prior art steel stud wall of FIG. 1, but is shown with the king studs loosely supported next to the intended door opening.

After the upper and lower tracks have been secured in place, steel studs (e.g., studs 41, 42, 43, 44, etc.) may each have a respective upper end be fixedly secured to the upper track 20, and may also have a respective lower end be fixedly secured to the lower track 30. In addition, other steel studs (e.g., studs 51, 52, 53, 54, etc.) may also have a respective upper end be fixedly secured to the upper track 20, and a respective lower end be fixedly secured to the lower track 31. The steel studs may be spaced as required (e.g., 16 inches on center). As seen in FIG. 2, a pair of steel studs (i.e., stud 40L and stud 50L) may be loosely positioned about the intended door opening 9, and may respectively lean against the next nearest stud locations (i.e., against stud 41 and stud 51), until a hollow metal door frame is delivered and ready for installation.

Figure 3:
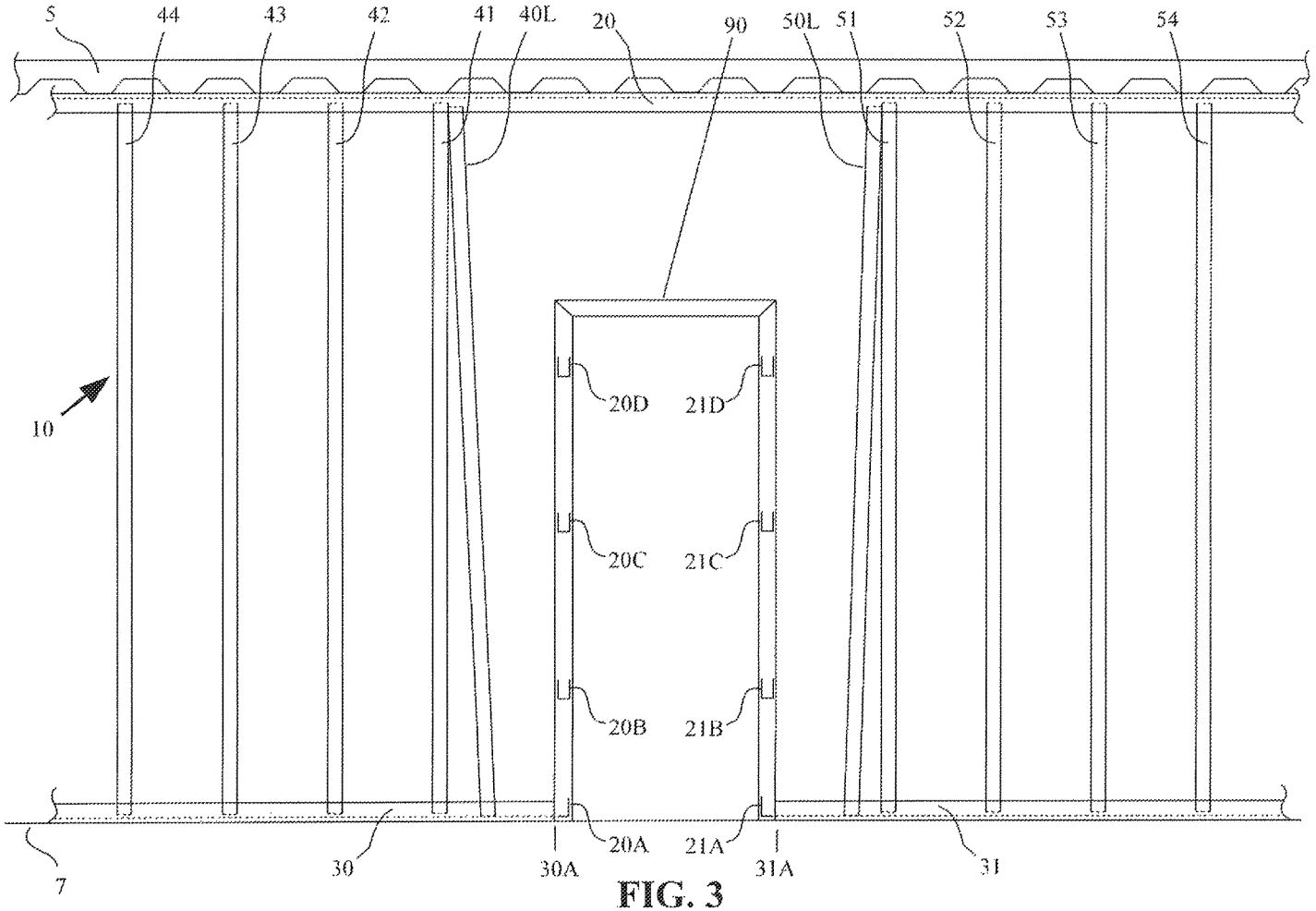
FIG. 3 (Prior Art)
FIG. 3 illustrates the prior art steel stud wall of FIG. 2, but is shown with the hollow metal door frame positioned in the intended opening.
Figure 4:
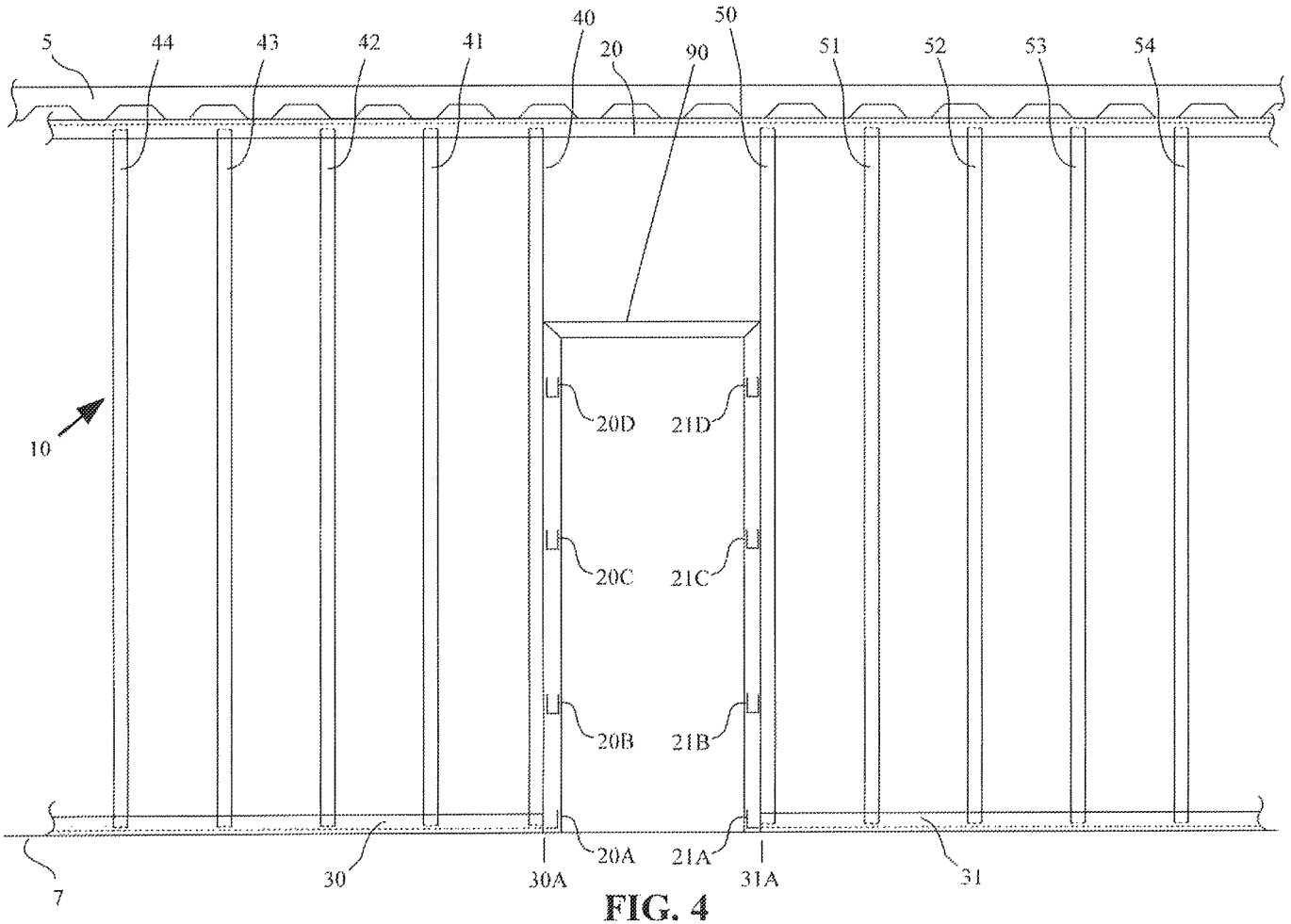
FIG. 4 (Prior Art)
FIG. 4 illustrates the prior art steel stud wall of FIG. 3, but is shown with the king studs secured to the opposing sides of the hollow metal door frame, and also secured to the top plate and bottom plate.

FIG. 3 illustrates the hollow metal door frame 90 being positioned in the intended door opening 9, between the ends 30A and 31A of the lower tracks 30 and 31 The front and rear of the hollow metal door frame 90 may be positioned to straddle the corresponding lower tracks (30/31), to allow roughly equal space for the thickness of the drywall to be applied on each side of the steel studs. Next, a proper sized spreader is positioned on the floor and inserted between the bottom inner sides of the hollow metal door frame 90, to set the proper spacing for the two sides in order to properly receive a 36 inch door therein. Then, a pair of base anchors (e.g., 20A and 21A) are used to secure the bottom of each side of the hollow metal door frame 90 to the floor 7, as seen in FIG. 4. The loose steel studs 40L and SOL are then respectively moved to the corresponding sides of the hollow metal door frame 90, and are thereat secured to each of the steel stud anchors of the door, and are also secured to the upper track 20, and the respective lower tracks 30/31. Note that there are usually three anchors for each of three hinges on the hinge side of the hollow metal door frame (e.g., anchors 20B, 20C, and 20D), and three anchors on the strike side as well (e.g., anchors 21B, 21C, and 21D). The pair of steel studs secured to the opposite sides of the hollow metal door frame become king studs 40 and 50.

Figure 5:
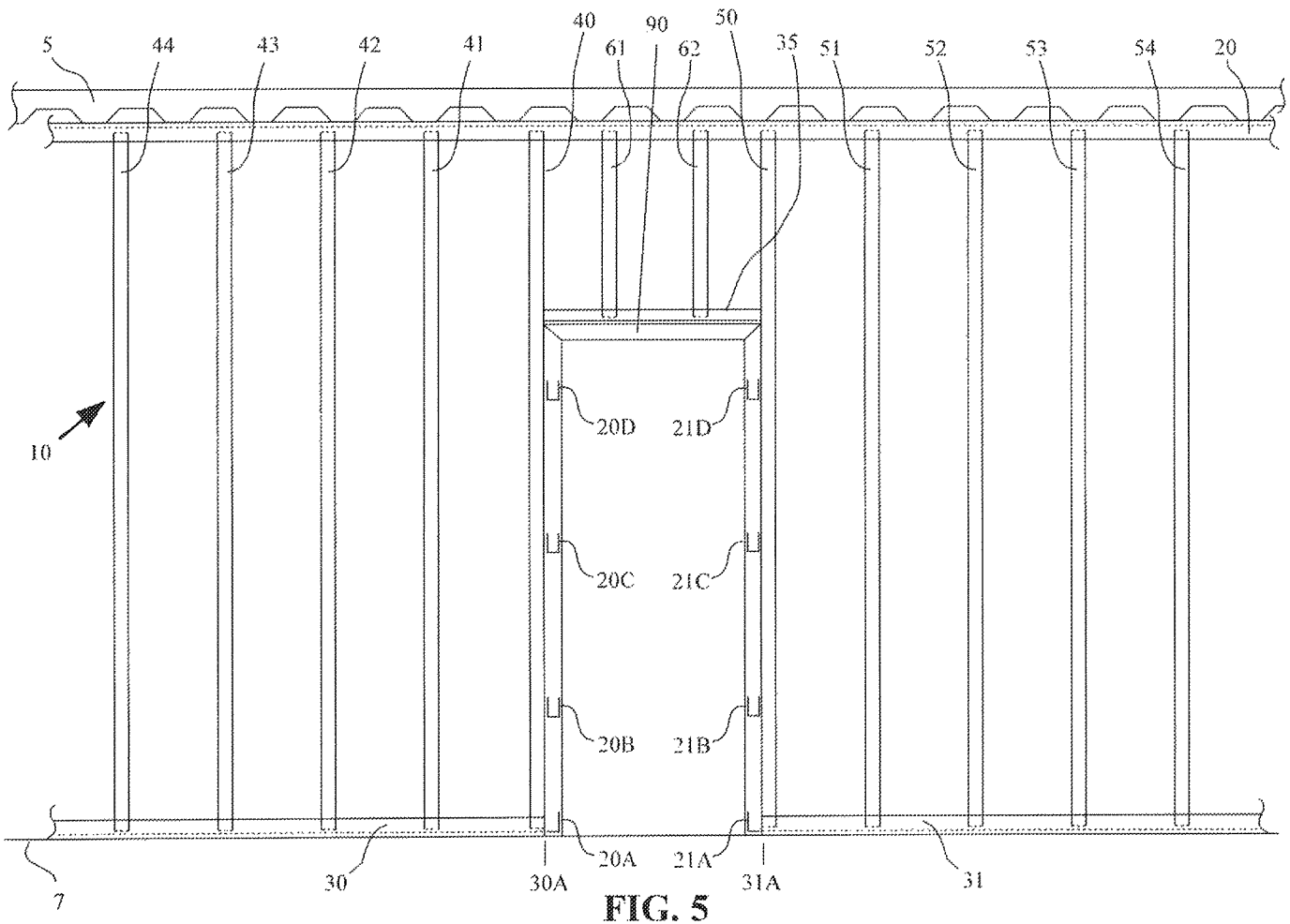
FIG. 5 (Prior Art)
FIG. 5 illustrates the prior art steel stud wall of FIG. 4, but is shown with the header installed above the door between the king studs, and with two cripple studs secured between the header and the top plate.

The next step in the construction of the prior art steel stud wall, as seen in FIG. 5, is to add a header 35 across the top of the hollow metal door frame 90. The two ends of the header 35 will be respectively secured to the king studs 40 and 50. Framing will generally be completed with the installation of crippling studs over the top of the door (e.g., studs 61 and 62), the upper ends of which may be fixedly secured to the upper track 20, while the lower ends may be fixedly secured to the header 35.

However, FIG. 2 and FIG. 5 illustrate a significant problem with the prior art wall construction. Further progress cannot be made on the prior art wall shown in FIG. 2 until the hollow metal door frame 90 is delivered and installed, as seen in FIG. 5—progress such as the installation of duct work over the door, routing of electrical wiring across the top of the door opening, applying the drywall to the studs, etc.

It is fairly common, to the point of being a recurring problem in the course of building construction, for the hollow metal door frames for the building to arrive late, typically arriving well behind the scheduled time for framing of the door opening for which they are intended. Not only does this hinder progress in constructing the wall, but during this time, construction workers ingress and egress through the space created for the door opening 9 seen in FIG. 2, in moving between rooms, and often stumble upon the upwardly protruding ends 30A and 31A of the lower tracks 30 and 31. Not only is this arrangement hazardous for the workers, particularly when carrying bulky items/materials through the opening, but incidental and repeated contact therewith may also cause damage to the ends 30A and 31A of the metallic lower tracks.

The header and jamb system and the associated method of constructing the steel stud wall according to the present invention avoids the hazardous and damaging contact between the construction workers and the ends 30A and 31A of the lower tracks.

Moreover, the header and jamb system and associated construction method described herein also permits all of the above-mentioned stages of construction to proceed (e.g., duct work and electrical wiring routed over the door), prior to having the hollow metal door frame delivered and installed in the opening.

Figure 6:
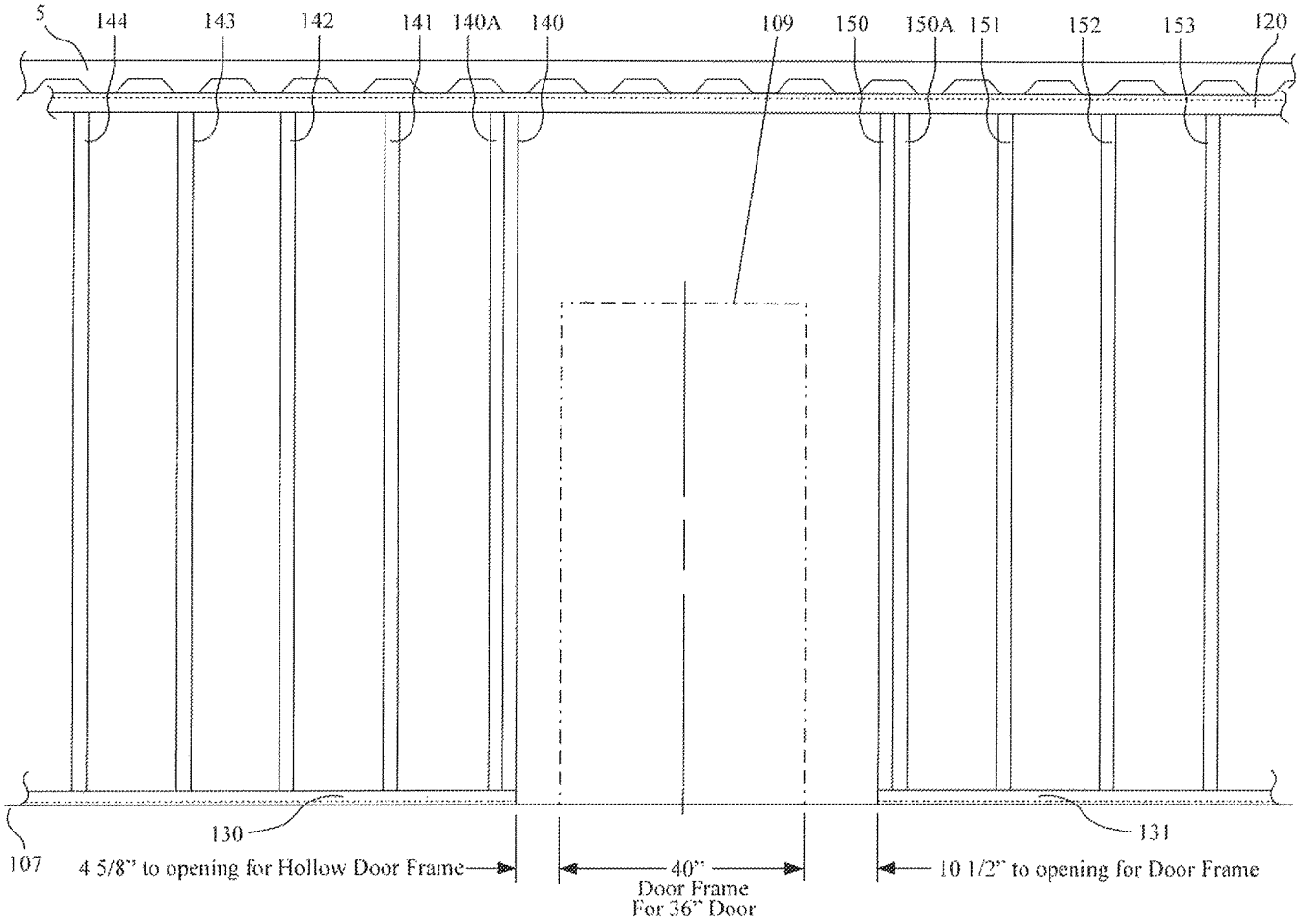
FIG. 6 illustrates a first stage of a steel stud wall formed in accordance with the present invention, and includes dual king studs and other suitably spaced steel studs.
Figure 9:
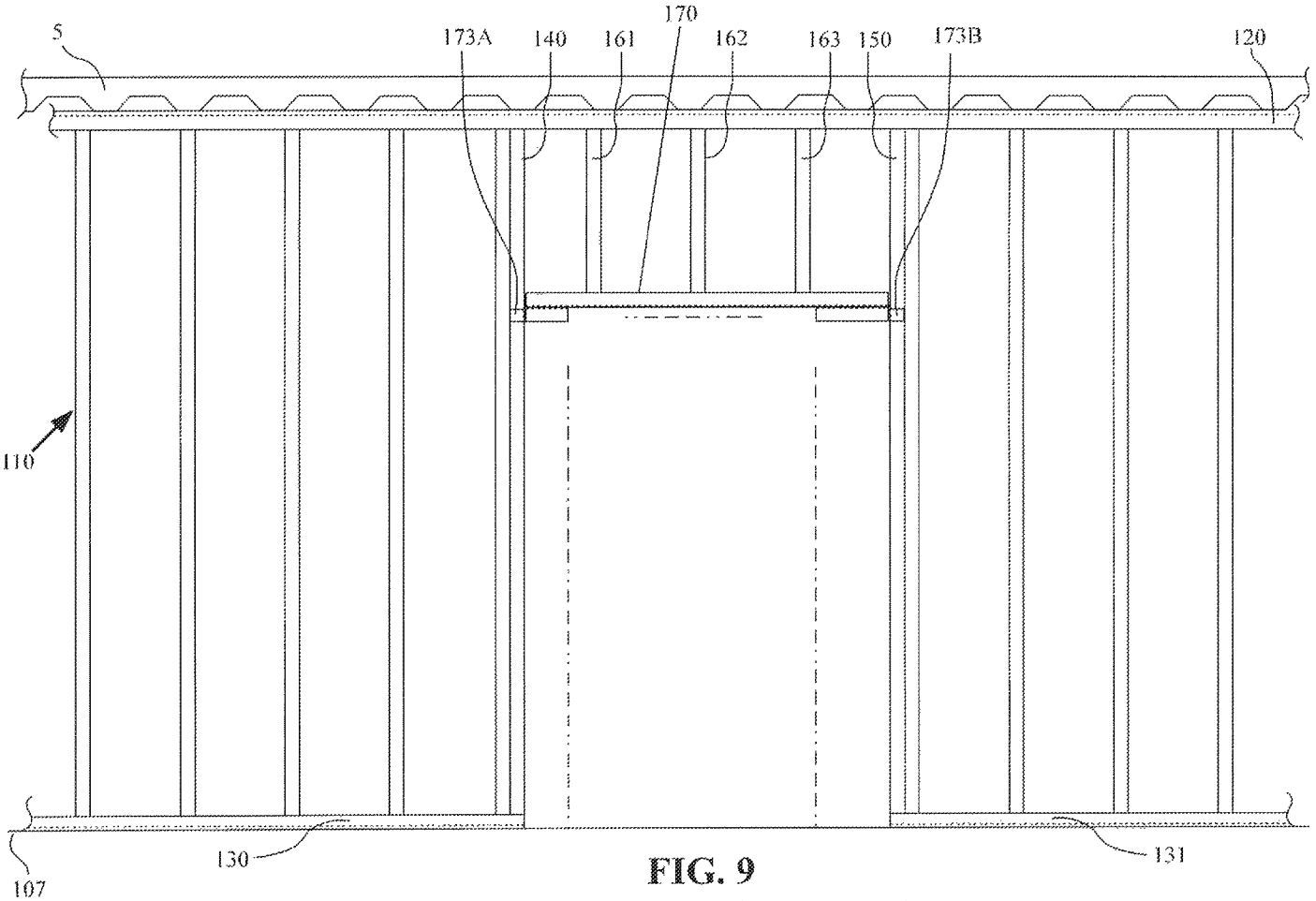
FIG. 9 illustrates the steel stud wall of FIG. 7, but is shown with crippling studs installed between the header and the top plate.

The first stage of constructing a framed wall 110 shown in FIG. 9, using the header and jamb system of the present invention, is shown in FIG. 6. This stage of the wall may be formed with an upper track 120 secured to the metal deck and concrete slab 5, and with two lower tracks (track 130 and track 131) being secured to the floor 107. To universally accommodate hanging of a 36 inch door and a corresponding hollow metal door frame with a standard two inch facing, a first king stud 140 may be secured to the upper and lower tracks to be roughly 4⅝$^{th}$ of an inch away from one side of the desired position of the 40 inch opening 109 for the door frame. Another king stud 150 may be secured to the upper and lower tracks to be roughly 10½ inches away from the other side of the desired position for the 40 inch opening 109 for the door frame. (Note—other spacing amounts other than 40 inches may be utilized for the installation of a hollow metal door frame that does not utilize the standard two inch facing on each side of the frame for the 36 inch door, and other spacing amounts would also be correspondingly utilized for a door size other than 36 inches). The advantageous use of the 10½ inch dimension and the 4⅝ inch dimension is described hereinafter. Additional king studs 140A and 150A may be respectively secured to the upper and lower tracks to be immediately adjacent to the king studs 140 and 150. Additional steel studs (e.g., studs 141, 142, 143, 144, etc., and studs 151, 152, 153, 154, etc.) may thereafter be spaced and secured with respect to the upper and lower tracks (120, 130, and 131) to frame the wall, which may be accomplished at this stage construction or a subsequent stage.

Figure 7:
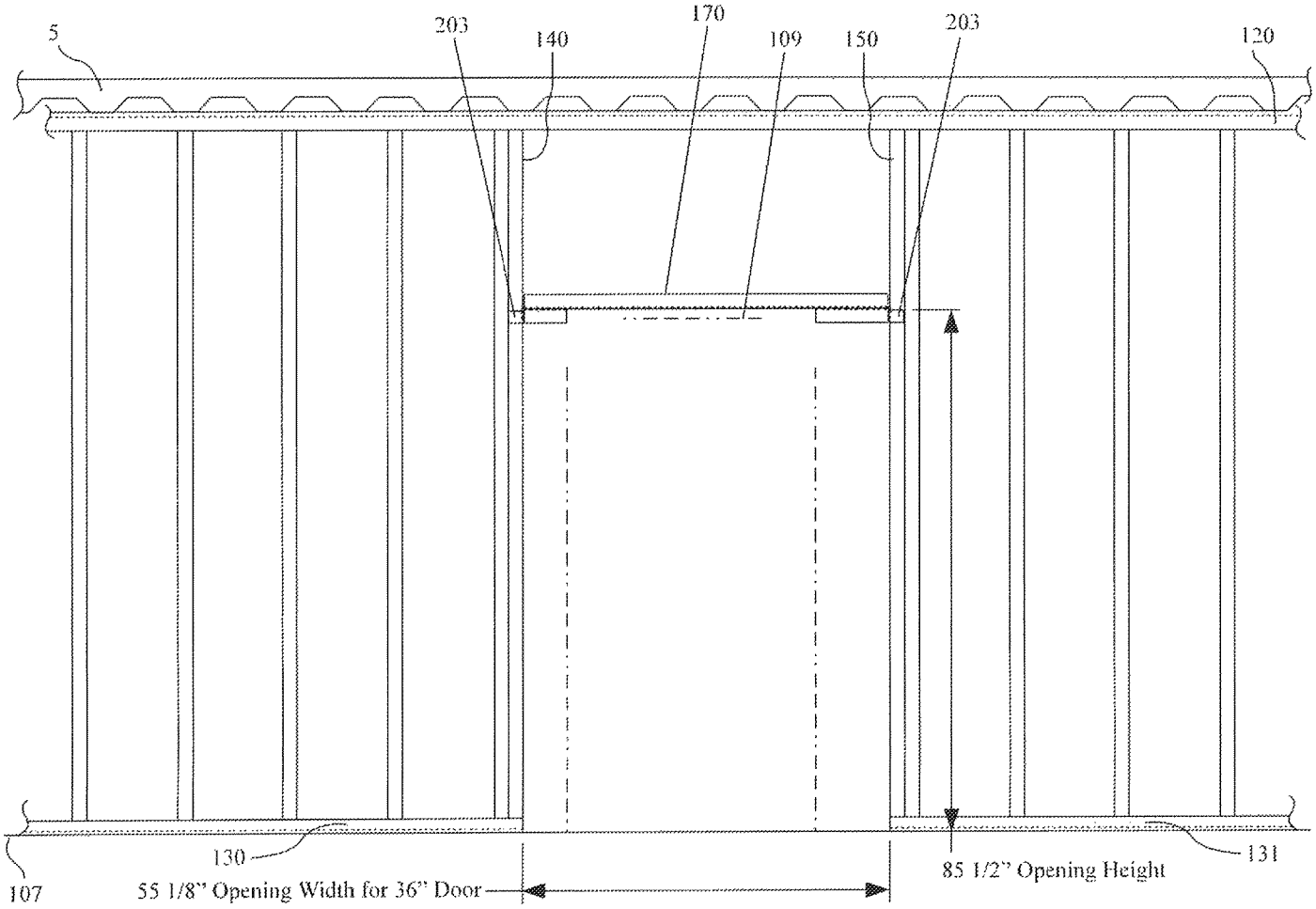
FIG. 7 shows the framed wall of FIG. 6, but with a pre-formed spreader header of the present invention installed between the king studs, to create an over-sized rough opening for a hollow metal door frame.
Figure 8B:
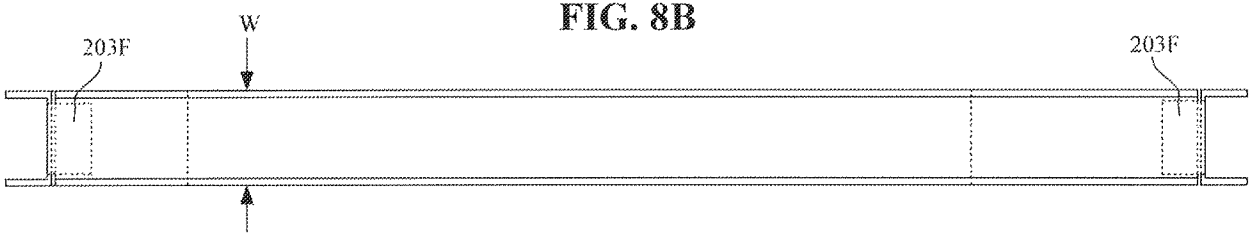
FIG. 8B shows a top view of the pre-formed spreader header of FIG. 8A.

The next step of the process is to install the spreader header 170 (or 170') of the present invention in the rough opening, as seen in FIG. 7, such that the mid-section of the header is roughly at a height of 85½ inches above the floor. The end flanges of the spreader header 203 (or 173A/173B) may be fixedly secured to the king studs 140 and 150 using conventional metal framing screws or a crimper. A first embodiment of the spreader header of the present invention is shown enlarged within the detail view of FIG. 8A, and in the top view of FIG. 8B and the section view of FIG. 8C. The steel spreader header 170' may be formed of a first channel section 173', a second channel section 183, a third channel section 193, and a fourth channel section 203, which may be utilized at two locations.

The first channel section 173', in its finished form, may have a base with flanges that extend from opposite sides of the base to form a U-shaped cross-section. The channel may extend from a first end 171 to a second end 172, and its flanges may be formed to a height H that may be roughly two inches. The width W of the channel section 173' may generally be about the same as that of the upper and lower tracks, so that it may receive steel stud frames between its flanges. The gauge of the channel section 173' may correspond to that used for the steel studs.

The second channel section 183 may have a first end 181 and a second end 182, and may be formed to have the same width W as does channel section 173'. The second channel section 183 may also have its flanges be formed to a height H that may be roughly two inches. The length of the channel section 183 (i.e., the distance between the first end 181 and second end 182) may be roughly 4⅝ inches, a numeric value is discussed in more detail hereinafter.

Figure 8A:
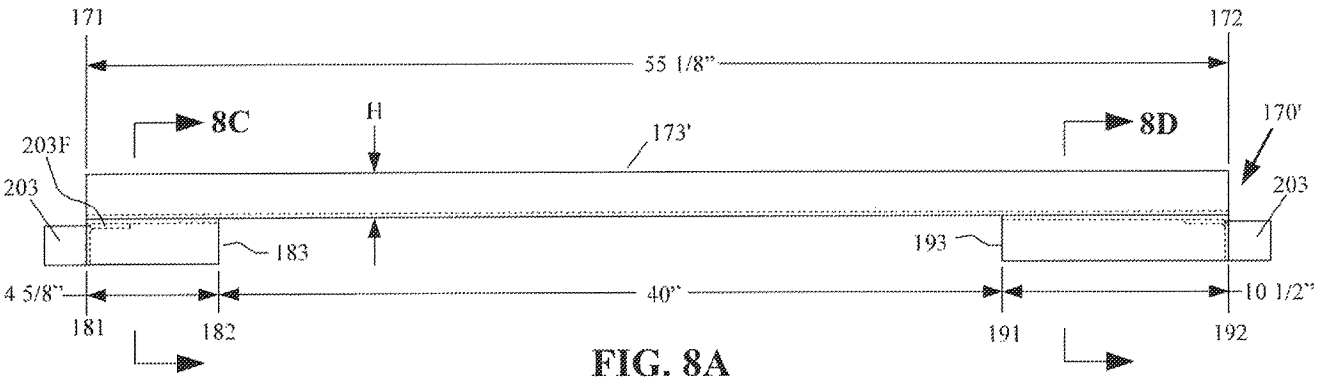
FIG. 8A illustrates an enlarged side view of a first embodiment of the pre-formed spreader header shown in FIG. 7.
Figure 8D:
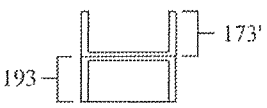
FIG. 8D is a cross-sectional view taken through a second end of the pre-formed spreader header of FIG. 8A.
Figure 8H:
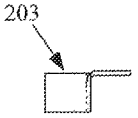
FIG. 8H shows a detail view of the end channel section of the spreader header of FIG. 8A.
Figure 8C:
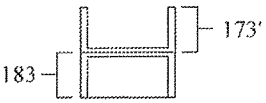
FIG. 8C is a cross-sectional view taken through a first end of the pre-formed spreader header of FIG. 8A.

To begin forming the spreader header 170', the second channel section 183 may be fixedly secured to the first channel section 173', such that its first end 181 is substantially coplanar with the first end 171 of the first channel section, as seen in FIG. 8A. The second channel section 183 may be fixedly secured to the first channel section 173' using any suitable means known in the art, including, but not limited to, welding the steel channels together, using mechanical fasteners therebetween, such as rivets, nuts and bolts, etc. It should also be noted that instead of using a separate channel section 183 that is fixedly secured to the first channel section 173', a pair of two inches flanges that are 4⅝$^{th}$ long may instead be welded to the first channel section to produce the H-shaped cross-section seen in FIG. 8C (and note this welded alternative for flange 183 may be lengthened to also encompass the similarly situated flange of channel 203, which is discussed hereinafter).

The third channel section 193 may have a first end 191 and a second end 192, and may be formed to have the same width W as channel section 173'. The third channel section 193 may also have its flanges be formed to a height H that may be roughly two inches. The length of the channel section 193 (i.e., the distance between the first end 191 and second end 192) may be roughly 10½ inches, a numeric value which is also discussed in more detail hereinafter.

To continue formation of the spreader header 170', the third channel section 193 may be fixedly secured to the first channel section 173', such that its second end 192 is substantially coplanar with the second end 172 of the first channel section 173', as seen in FIG. 8A. The distance between the second end 182 of the second channel section 183 and the first end 191 of the third channel section 193 may be 40 inches (i.e., the width of the hollow metal door frame—36 inches—plus a two inch face on each side, for a 36 inch door). Note that for other size doors with corresponding door frames, this 40 inch spacing would be modified (i.e., it may be 34 inches for a 30 inch door and door frame, or 52 inches for a 48 inch door and door frame, etc.). It should also be noted that the 55⅛" framed opening would also correspondingly change. The third channel section 193 may also be fixedly secured to the first channel section 173' using any suitable means known in the art. Additionally, instead of using a separate channel section 193 that is fixedly secured to the first channel section 173', a pair of two inches flanges that are 10½" long may be welded to the first channel section to produce the H-shaped cross-section seen in FIG. 8D.

One additional channel section shape 203 may be used to form the spreader header 170', and may be used at two locations—being at each of the ends of the header. The channel 203 may be formed with a bent flange 203F. A first channel 203 may be fixedly secured to the channel 173' at its first end 171 using flange 203F, and a second channel 203 may be fixedly secured to the channel 173' at its second end 172 using flange 203F, as seen in FIG. 8A and FIG. 8B.

Figure 8F:
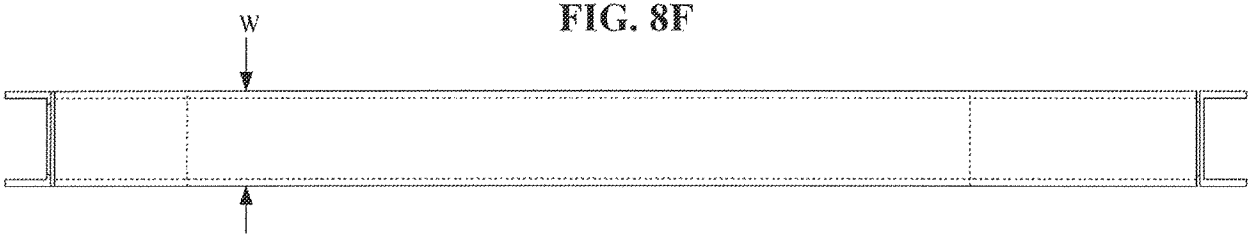
FIG. 8F shows a top view of the pre-formed spreader header of FIG. 8E.
Figure 8E:
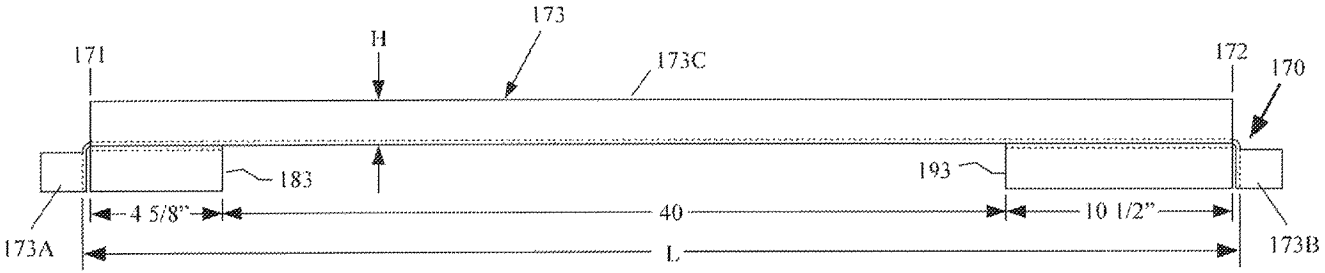
FIG. 8E illustrates an enlarged detail view of a second embodiment of the pre-formed spreader header shown in FIG. 7.
Figure 8G:
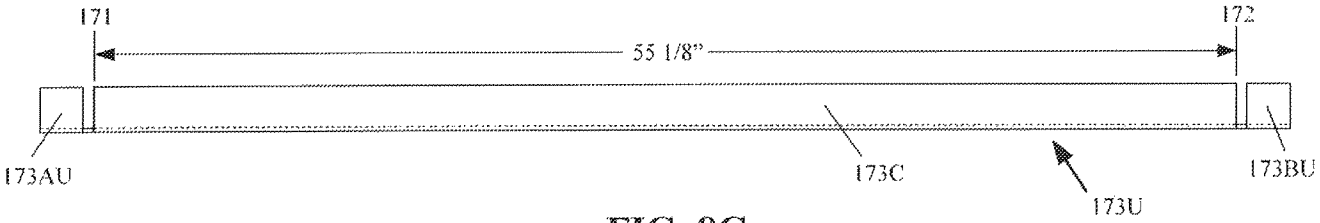
FIG. 8G shows a view of the main channel section of the pre-formed spreader header of FIG. 8E, but is shown prior to bending of the ends of the channel.

Another embodiment of the spreader header of FIG. 7 is shown in FIGS. 8E-8G. The spreader header 170 shown in FIG. 8E may generally have the same features as header 170', but may be formed of only three channel sections. The same channel sections 183 and 193 may again be used, as with spreader header 170', but use of a separate channel section 203 may be eliminated by forming a channel 173. The unformed channel section 173U, as seen in FIG. 8G, may be longer than length L, and may have cuts made in the upstanding flanges, so that a center channel section 173C may be formed to have flange lengths of 55⅛", and may have two unformed end channel sections 173AU and 173BU. The two unformed end channel sections 173AU and 173BU are connected to the center section 173C through the base of the channel. Each of the two unformed end channel sections 173AU and 173BU may then be bent with respect to the center section 173C, using a bend radius in the base, to form the channels 173A and 173B, as seen in FIG. 8E, each of which may be roughly at a 90 degree angle to the base of the channel 173C.

The length L between the outside surfaces of the flanges of the two channels 173A and 173B of the spreader header 170 may be fractionally larger than 55⅛", because of the bend radii and the flange thicknesses. This fractional increase may be accounted for in the spacing of the king studs 40 and 50, in order for the header to smoothly fit therebetween. Alternatively, relief cut may be made in the base of channel 173C in order to form the bend radius to be tucked within the 55⅛ inch length.

As seen in FIG. 9, after the spreader header 170 is installed between the king studs 140 and 150, a series of crippling studs (e.g., 161, 162, 163, etc.) may each be fixedly secured to both the spreader header 170 and to the top plate 120.

The framed wall 110 shown in FIG. 9 has a rough opening that may be further constructed to receive a hollow metal door frame, as disclosed hereinafter, but already has king studs (e.g., 140 and 150) that are respectively secured to the two lower tracks (track 130 and track 131). Therefore, construction workers may ingress and egress through the opening without stumbling upon any exposed open ends of the lower tracks, as with the prior art wall shown in FIG. 2.

Figure 10:
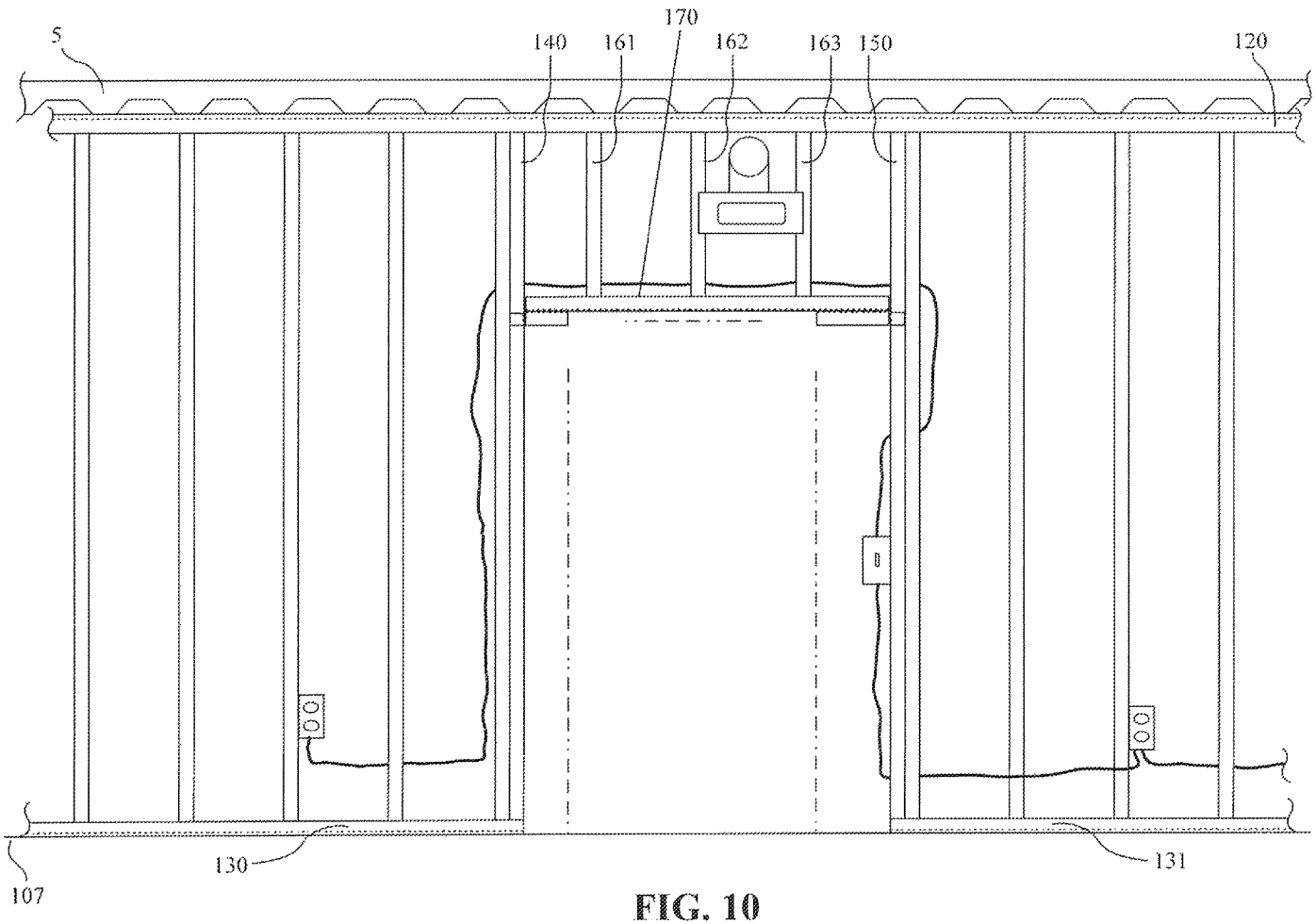
FIG. 10 illustrates the steel stud wall of FIG. 9, but is shown with electrical wiring running through the openings in the steel studs and over the header to sockets/switches, and with duct work installed above the header.
Figure 11:
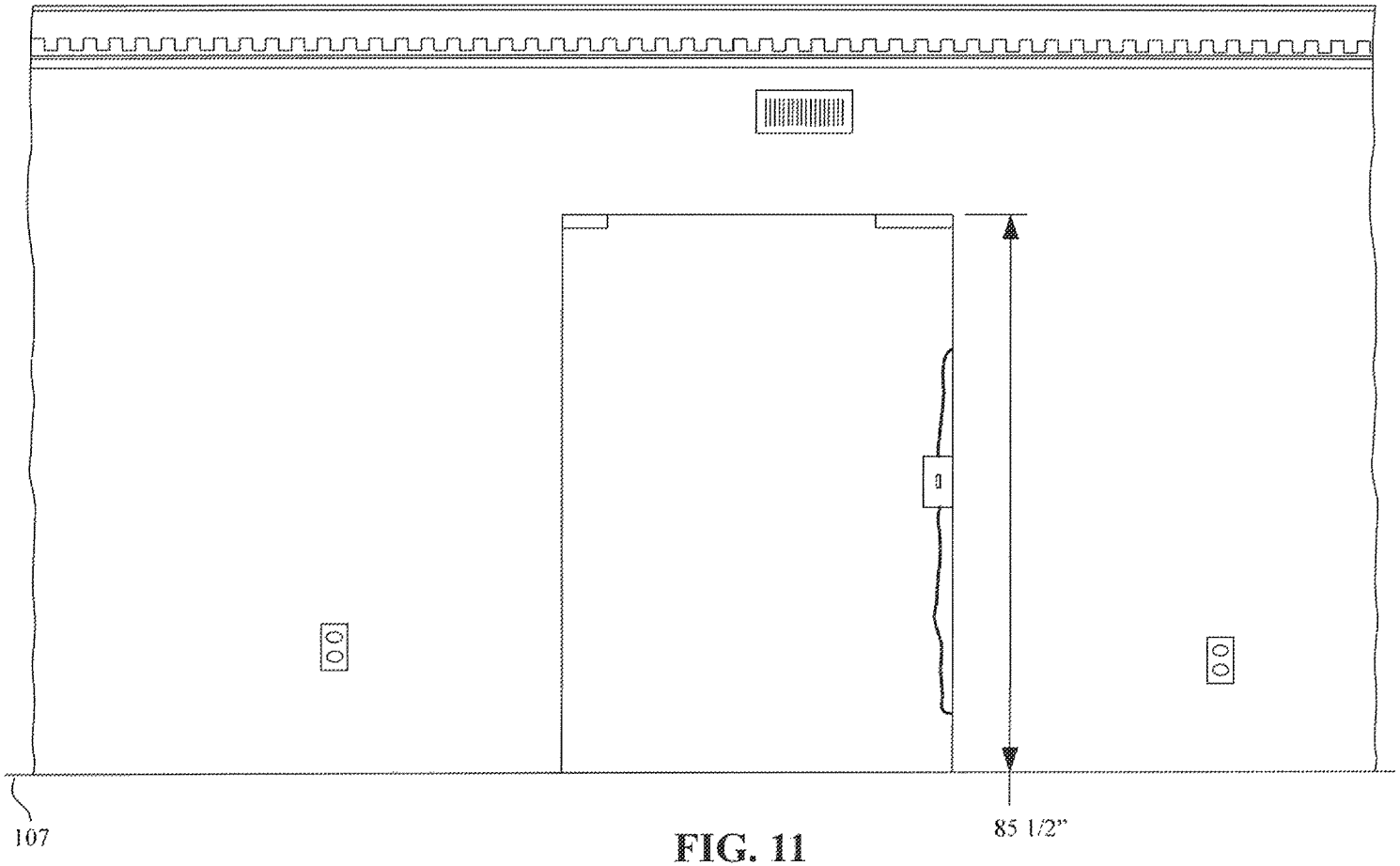
FIG. 11 illustrates the steel stud wall of FIG. 10, but is shown after the wall is finished with drywall, excluding the lower portion of the preformed header, and the wall is also shown with a crown molding applied thereto, and a vent grille.

Moreover, because installation of the spreader header and crippling studs is completed for wall 110 of the present invention, the other required construction steps with respect to the wall may proceed even in the absence of having the necessary hollow metal door frame delivered. As shown in FIG. 10, the necessary electrical wiring may be routed over the top of the spreader header 170 and through the crippling studs 161, 162, and 163. Any required duct work may also be completed, including the air outlet needed above the spreader header 170. Furthermore, as seen in FIG. 11, the drywall may be applied to both sides of the studs, without having the hollow metal door frame installed in the rough opening. The dry wall may even be taped, mudded, and painted, and upper and lower molding may be secured to the where the wall meets the ceiling and the floor. Electrical cover plates and a vent outlet grille, as shown therein, may also be secured in place. Work may proceed to completion even in the absence of having the hollow door fame onsite.

Figure 12:
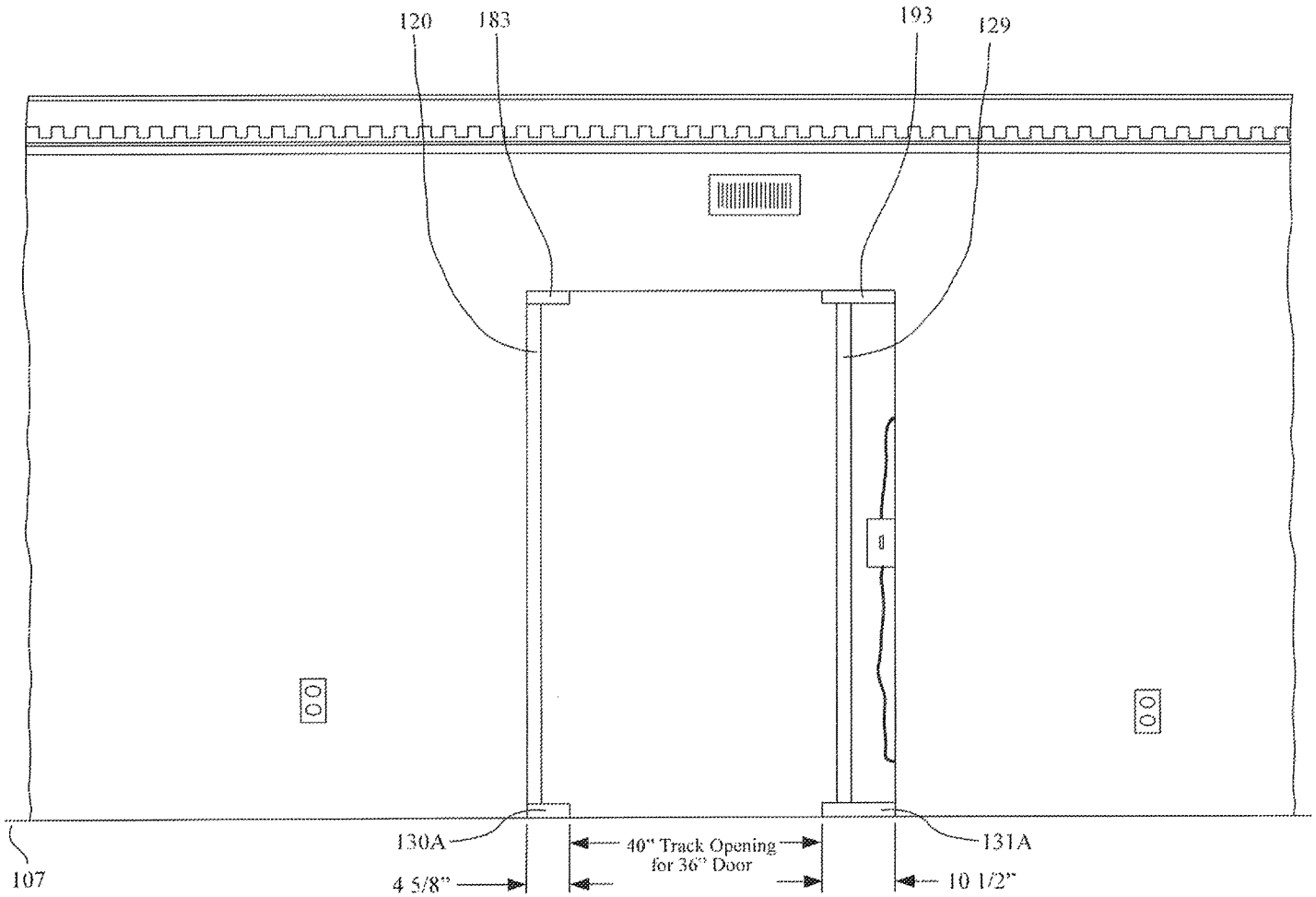
FIG. 12 illustrates the partially finished wall of FIG. 11, but is shown after a jack stud and jamb track are installed on each side of the rough opening, just prior to installation of the metal door frame.

Once the hollow metal door frame arrives at the building site, the final stages of constructing the wall of the present invention may proceed. As seen in FIG. 12, a first lower track 130A having a length of 4⅝" may be secured to the floor 107 to extend from the king stud 140 toward the center of the rough opening. A second lower track 131A having a length of 10½" may be secured to the floor 107 to extend from the king stud 150 toward the center of the rough opening. Being so installed, the lower track 130A will be positioned directly below the 4⅝" long channel section 183, and the lower track 131A will be positioned directly below the 10½" long channel section 193. It may thus be understood that the size of each lower track is to mirror/match the size of the channel section directly above it, as the channel sections also serve as a corresponding "track" for subsequent placement/securement of studs.

A first jack stud 120 may then have its upper end be fixedly secured to the channel section 183, and its lower end fixedly secured to the lower track 130A, to be adjacent the king stud 140. Another jack stud 129 may be fixedly secured to both the channel section 193 and the lower track 131A, and may be positioned a distance away from the inner end of the track, being a distance equal to the width of the steel studs.

Figure 13:
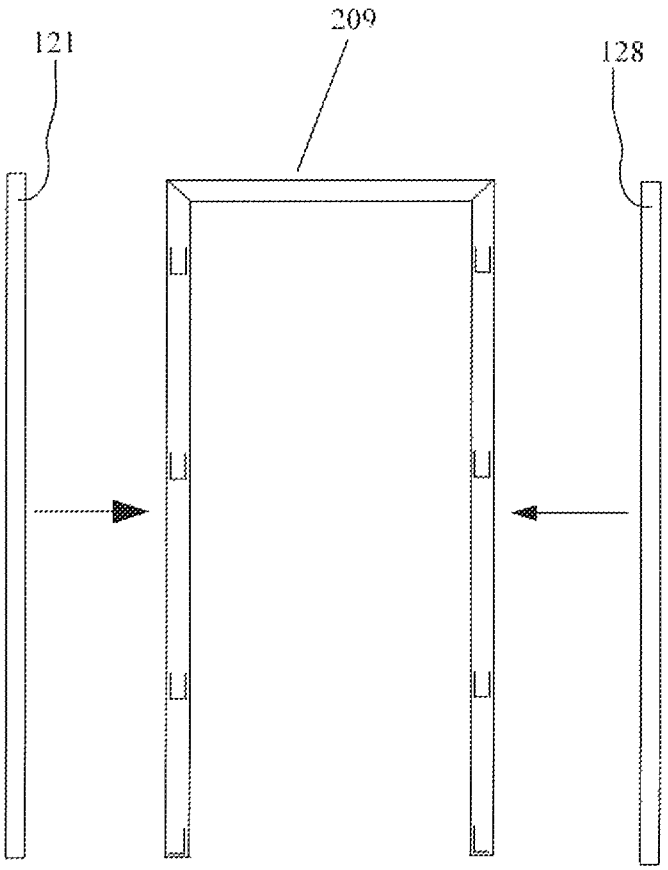
FIG. 13 illustrates a hollow metal door frame, and a pair of loose jack studs prior to respective attachment to each side of the door frame.
Figure 14:
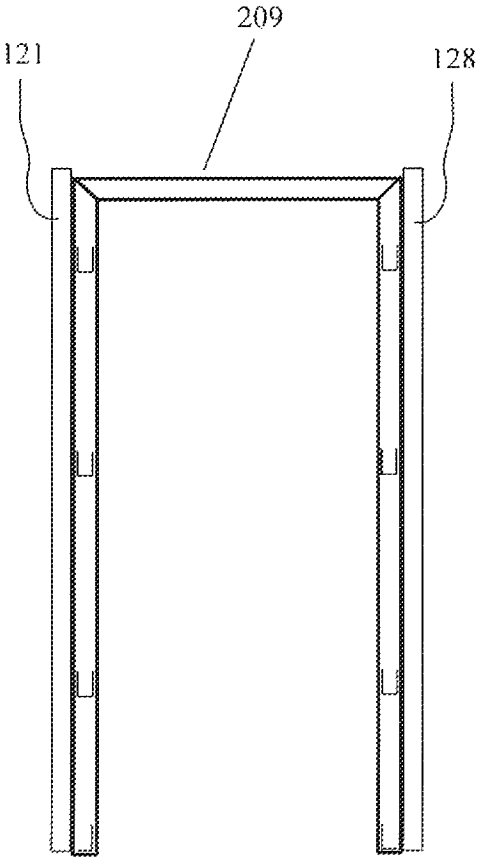
FIG. 14 illustrates the hollow metal door frame of FIG. 13, after attachment of the jack studs to the sides of the door frame.

Next, the hollow metal door frame may be prepared for installation into the opening of the present invention shown in FIG. 12. FIG. 13 shows a hollow metal door frame 209 and two jack studs 121 and 128, just prior to the studs being secured to the door frame. In FIG. 14, the jack studs are shown secured to the anchors of the door frame 209. The length of each of the jack studs 121 and 128, and the corresponding attachment position on the door frame 209 may be such that the bottom ends of the studs are each positioned slightly above the bottom of the door frame, and the upper ends may terminate above the top of the door frame, being sufficient to enable its subsequent attachment.

The door frame 209 with the jack studs 121 and 128 secured thereto, as seen in FIG. 14, may now be distributed into the opening shown in FIG. 12, by angling the door frame/stud assembly toward the wall, and by elevating the head of the door frame 209 toward the spreader header. The top end of the jack stud 121 that extends beyond the door frame may be received within the channel section 183, and the top end of the jack stud 128 may similarly be received within the channel section 193. Then the bottom of the door frame 209 and the bottoms of the jack studs 121 and 128 may be swung towards the wall to be plumb with the floor, with the door frame thereafter being lowered to contact the floor 107, with the bottom ends of the jack studs 121 and 128 being respectively received within the lower track 130A and the lower track 131A. The portion of the upper ends of the jack studs 121 and 128 respectively nested within the channel section 183 and the channel section 193 may be fixedly secured thereto. Also, the portion of the lower ends of the jack studs 121 and 128 respectively nested within the lower track 130A and lower track 131A may be fixedly secured thereto. (Note that in another embodiment, the jack studs need not be initially secured to the door frame prior to its installation in the opening, and may instead be placed in the tracks similar to the prior art approach shown in FIG. 3, and may be subsequently be secured to the tracks and to the door frame).

Figure 15:
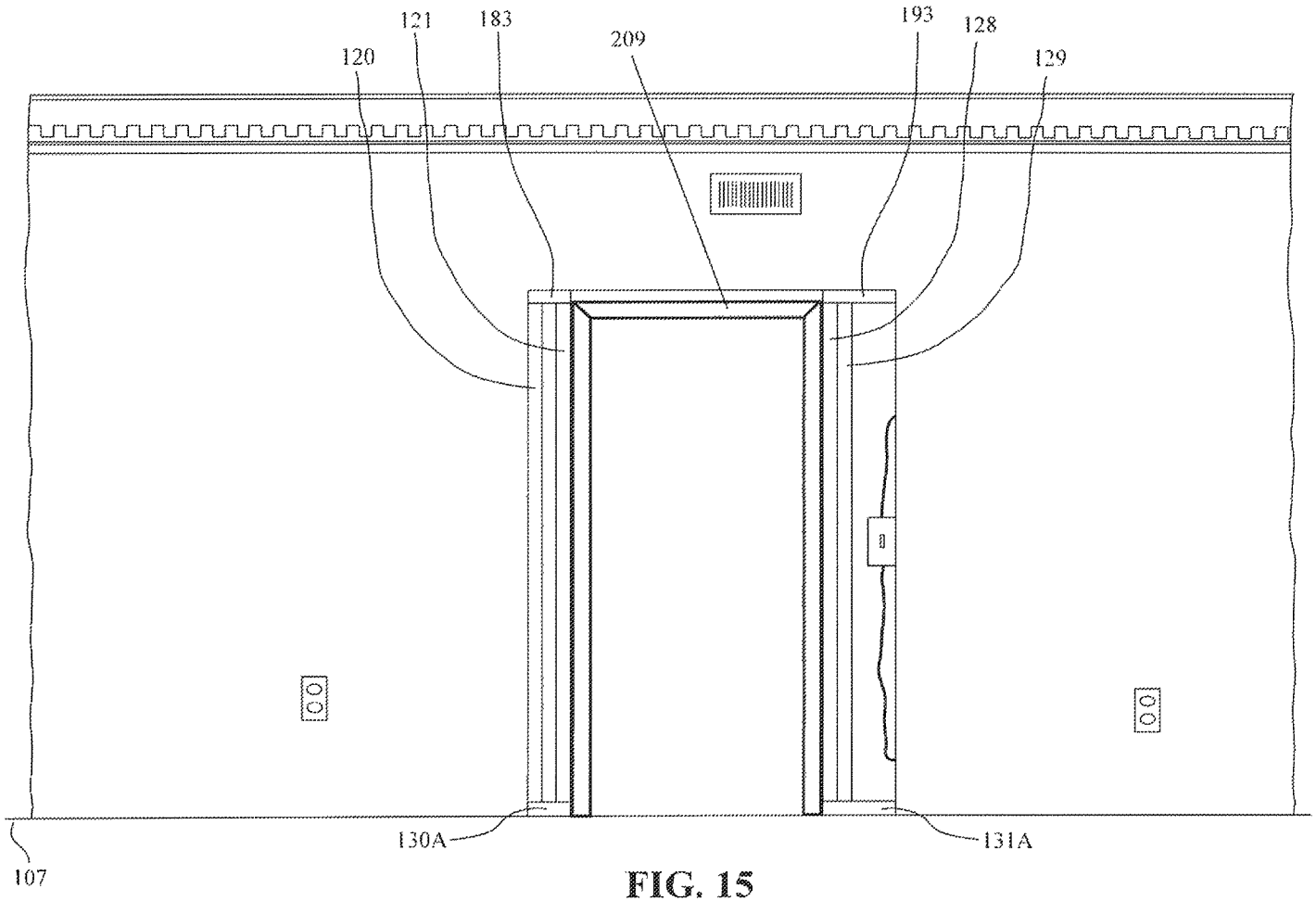
FIG. 15 illustrates the wall of FIG. 12, but is shown after the hollow metal door frame with studs mounted thereto, as seen in FIG. 11, has been placed into the rough opening, with both of the jack studs being secured to the pre-formed header, and each also being secured to the respective lower jamb track.
Figure 16B:
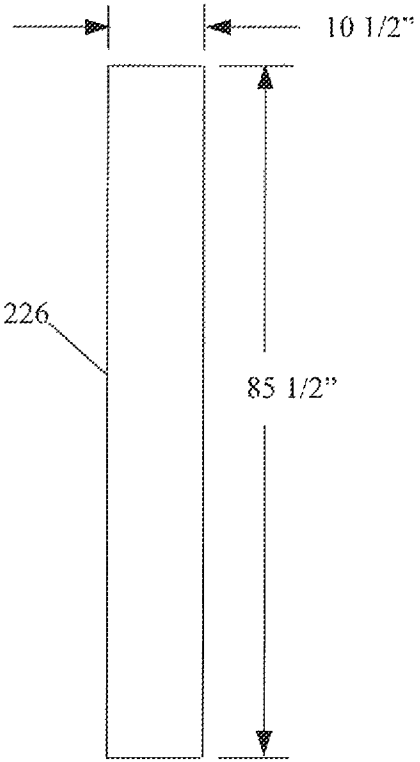
FIG. 16A and FIG. 16B respectively illustrate first and second pieces of pre-cut drywall that are usable to finish the exposed studs on each of the sides of the wall of FIG. 15.
Figure 16A:
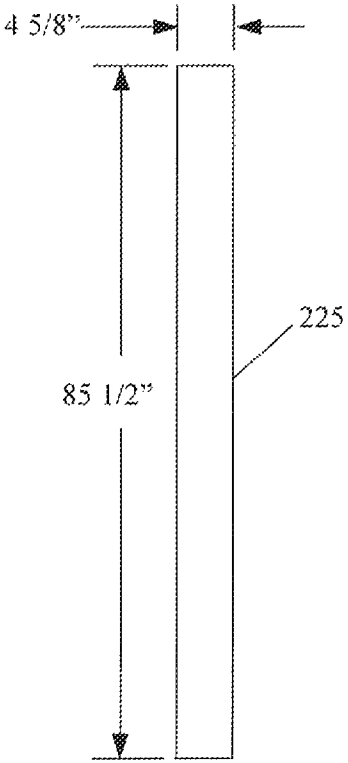
Figure 17:
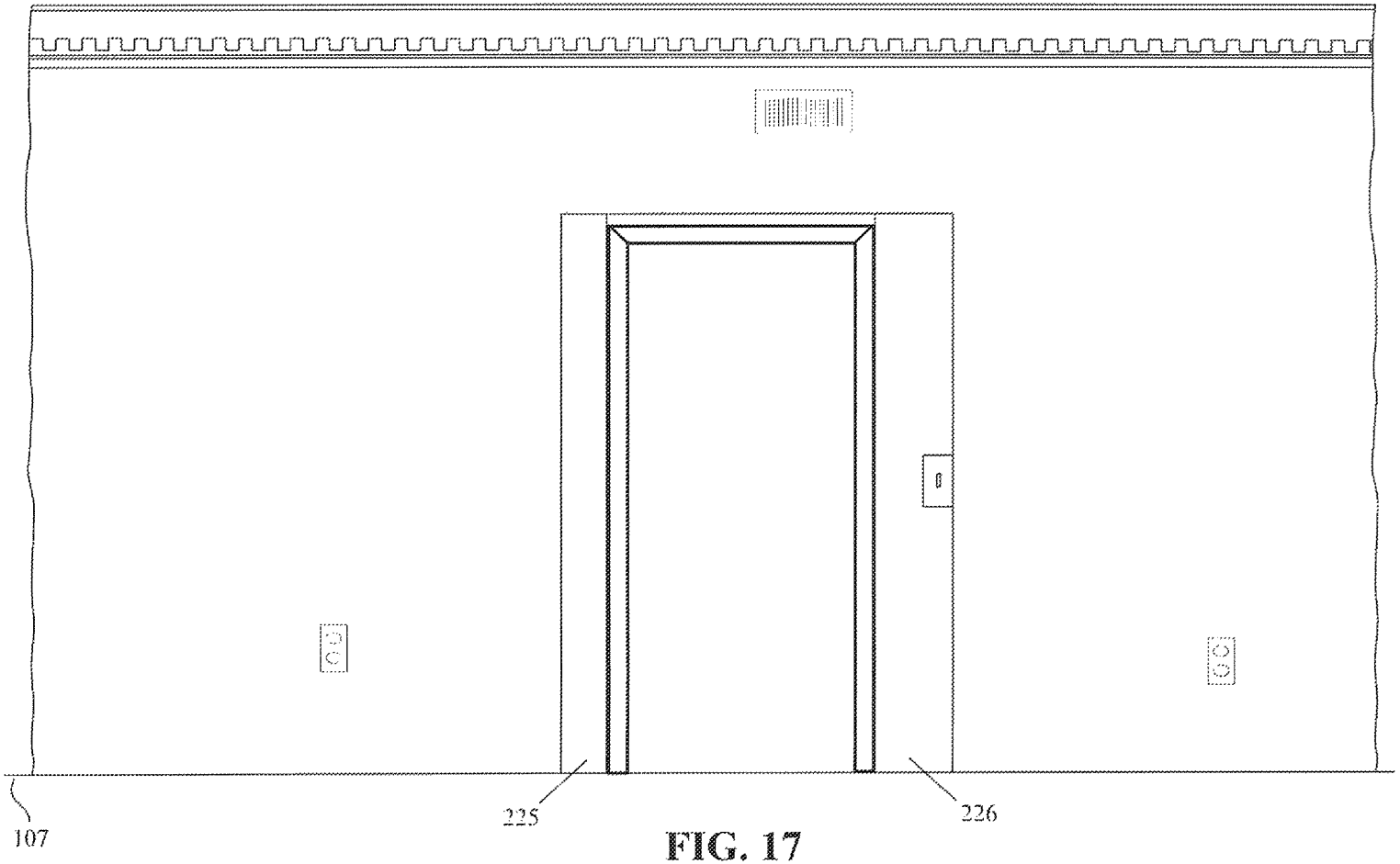
FIG. 17 illustrates the steel stud wall of FIG. 15, but is shown after the pre-cut drywall pieces of FIGS. 16A and 16B have been fixedly secured thereto.
Figure 18:
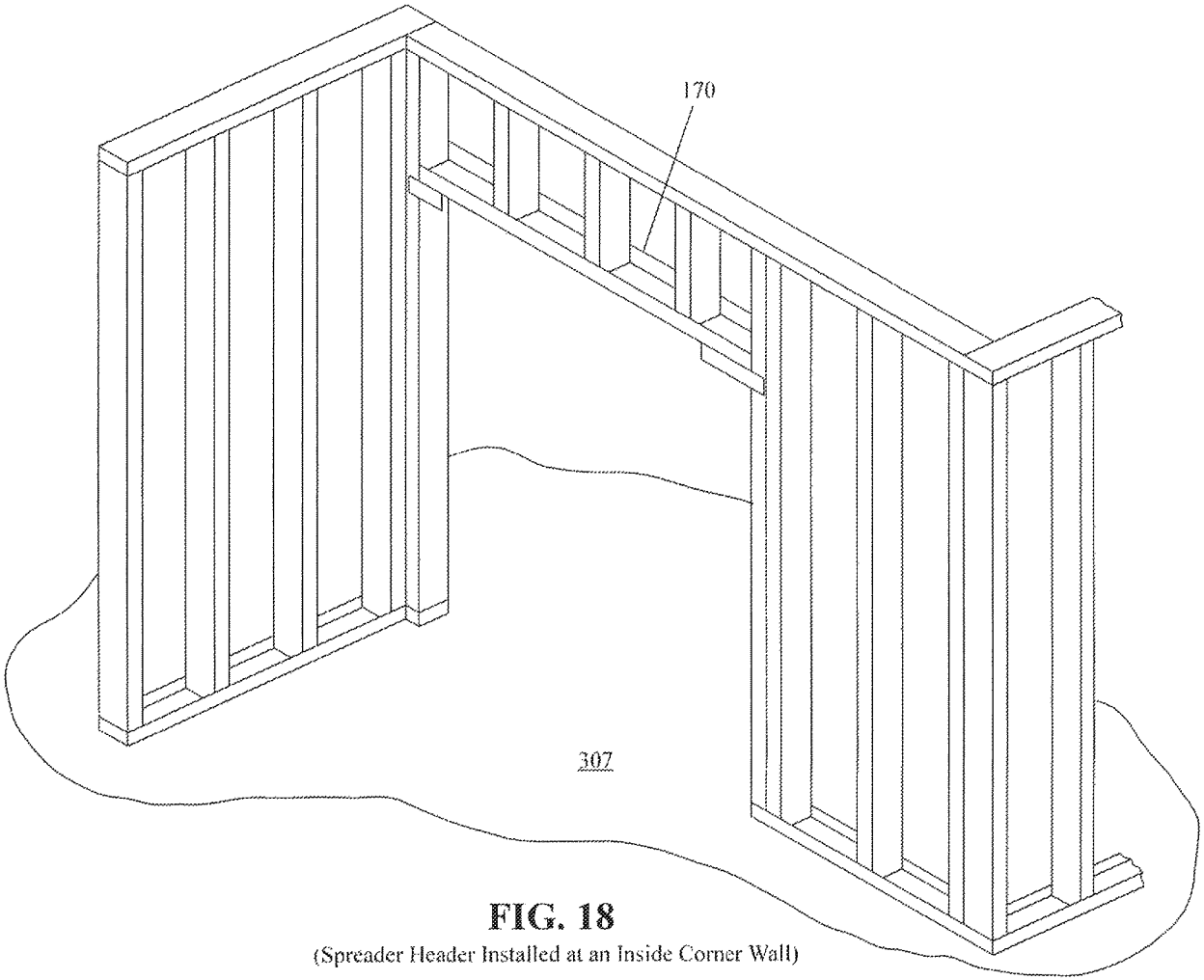
FIG. 18 illustrates installation of the spreader header of the present invention in framing a wall adjacent to an intersecting wall, for placement of the door of the new wall in optimal close proximity to the corner.

The installed door frame 209 may then appear as seen in FIG. 15, with two small sections of the wall, on each side thereof, not yet being covered by drywall. Small pre-cut sections of drywall (225 and 226), as seen in FIGS. 16A and 16B, may be produced to the required dimensions, and may be secured to the wall, as seen in FIG. 17. The same pre-cut drywall sections may be used on both the near and far sides of the wall. The remaining joints between the drywall section 225 and the adjacent drywall, as well the joints between the drywall section 226 and its adjacent drywall section, may then be taped, mudded, and painted as desired, to complete construction of the wall.

The required components to form the wall of the present invention, for a given size door, may be pre-formed and supplied as a kit, which may include the steel spreader header, jamb tracks, jack studs, and the cripple studs. The pre-cut 4⅝" and 10½" dry wall pieces may also be supplied as part of the kit.

The advantageous use of the 10½ inch dimension and the 4⅝$^{rd}$ of an inch dimension may be described in relation to the installation of a hollow metal door frame in the corner of a room, adjacent to an intersecting wall, as seen in FIG. 17. The 4⅝$^{th}$ feature size of channel 183 of the spreader header 170 and of the jamb track 130A provide an optimal minimum dimension for positioning of the hollow metal door frame (and thus the door) into close proximity with the intersecting wall, when a single layer of ⅝" thick drywall is used. The 10½ inch dimension generally provides minimum space requirements for most electric boxes (e.g., double light switches) that may need to be mounted on the other side of the door. In another embodiment, the 10½ inch dimension may be increased to accommodate special conditions encountered in the field, and may be, for example, 16 inches, which may accommodate a plurality of light switches needed at a particular location (e.g., a four-gang box for four switches, or a six-gang box, etc.). In yet a further embodiment, the 4⅝ inch dimension may similarly be increased (i.e., up to 10½ inches or 16 inches) where there is no requirement for placement at an intersecting wall and there may be a requirement for a gang box on each side, or it may even be eliminated in another embodiment.

Figure 19:
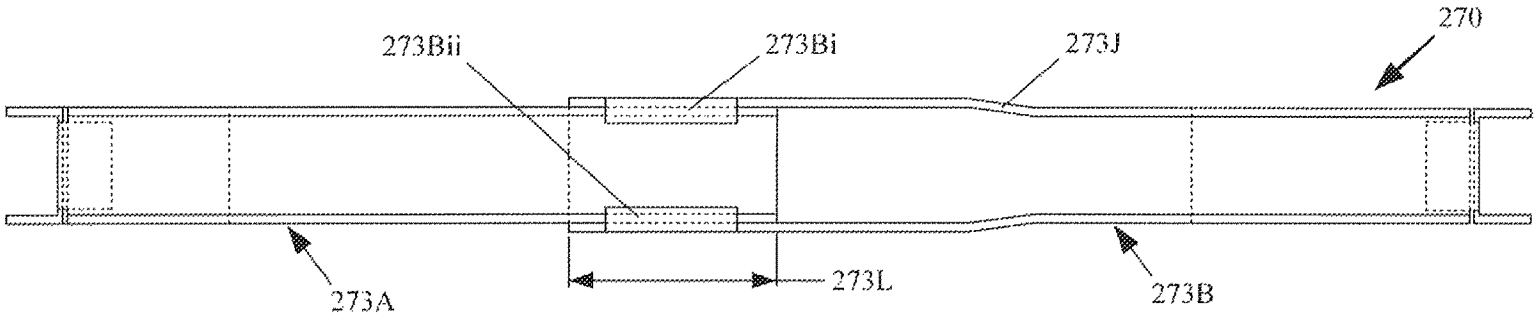
FIG. 19 illustrates a third embodiment of the pre-formed header of the present invention.

Another embodiment is shown by the spreader header 270 illustrated in FIG. 19A, which may be constructed to be similar to header 170 (or header 170'), except that instead of a single channel 173 (or the channel 173'), it may have a first channel 273A that may nest within a second channel 273B. The nested channels 273A'273B may permit expansion of or reduction to the length of the header 270, to universally accommodate the different stud spacing discussed hereinabove, other than just the 55⅛ inch spacing shown in FIG. 7 for use with a 36 inch door (i.e., to also be able to accommodate a 30 inch door and door frame, or a 48 inch door and frame, or a 52 inch door and frame, etc., using the same header). To maintain the nested relationship of channel 273A with respect to channel 273B, a first return flange 273Bi and a second return flange 273Bii may each be respectively formed on, or welded to, the laterally extending flanges of channel 273. The channel 273 may be formed with or without the joggles 273J. When formed without the joggles, the larger cross-section of the channel 273B shown in FIG. 19 may be continuous throughout its length, which may still nonetheless be capable of receiving the studs therein, as the actual gauges of metal that may be used are generally not very large (i.e., the wall thicknesses for the channels shown throughout each of the figures has been enlarged to be easily discernable by the reader). Also the nominal length 273L of the overlap between the nested first channel 273A and the second channel 273B may be greater than shown (i.e., being large enough to accommodate many common door/frame sizes). The nominal length 273L of the overlap between the nested first channel 273A and the second channel 273B may also extend for the entire length of the two channels.

The spreader header 270 may be installed substantially the same as discussed above for header 170 (and for header 170'), and as shown within FIG. 7, except for the length adjustment that may be provided by the nested channels 273A/273B. Once the length of the header 270 has been set and its ends are secured to the king studs 140/150, a series of screws may be used to fixedly secure the two nested channels 273A/273B together.

While illustrative implementations of one or more embodiments of the present invention are provided hereinabove, those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A pre-formed header assembly, for use in creating a rough opening for a metal door frame in a wall, said pre-formed header configured to be secured to a first king stud and a second king stud at respective king stud locations being selectively spaced apart for a particular door size and corresponding metal door frame, said pre-formed header comprising:

a first channel member having a first end and a second end, formed with a length between said first and second ends; said first channel comprising an elongated base and a pair of flanges extending laterally from opposite sides thereof to form a U-shaped cross-section;

a second channel member having a first end and a second end, formed with a distance between said first and second ends of said second channel member; said second channel comprising an elongated base and a pair of flanges extending laterally from opposite sides thereof to form a U-shaped cross-section; said base of said second channel member fixedly secured to said base of said first channel member, with said first end of said second channel member positioned proximate to said first end of said second channel member, and with said pair of flanges of said second channel member substantially aligned with said pair of flanges of said first channel member;

a third channel member having a first end and a second end, formed with a span between said first and second ends of said third channel member; said third channel comprising an elongated base and a pair of flanges extending laterally from opposite sides thereof to form a U-shaped cross-section; said base of said third channel member fixedly secured to said base of said first channel member, with said second end of said third channel member positioned proximate to said second end of said first channel member, and with said pair of flanges of said third channel member substantially aligned with said pair of flanges of said first channel member;

a fourth channel member comprising a base and a pair of flanges extending laterally from opposite sides thereof to form a U-shaped cross-section; said base of said fourth channel member fixedly secured to said base of said first channel member, substantially perpendicular thereto, said pair of flanges of said fourth channel member configured to protrude away from, and be substantially aligned with, said pair of flanges of said second channel member, being configured for attachment to the first king stud;

a fifth channel member formed substantially the same as said fourth channel member; said base of said fifth channel member fixedly secured to said base of said first channel member and being substantially perpendicular thereto, said pair of flanges of said fifth channel member configured to protrude away from, and be substantially aligned with, said pair of flanges of said third channel member, being configured for attachment to the second king stud;

wherein a gap between said base of said fourth channel member and said base of said fifth channel member is configured for mounting of said base of said fourth channel member and said base of said fifth channel member to the selectively spaced apart first king stud and second king stud, respectively; and wherein a difference between said length, and the combination of said distance plus said span, is sized to receive a width of the metal door frame therebetween.

2. The pre-formed header assembly according to claim 1 wherein said distance is configured to provide a minimum spacing required to position the metal door frame in close proximity to an intersecting wall.

3. The pre-formed header assembly according to claim 2 wherein said span is configured to provide a minimum amount of space required for an electrical box.

4. The pre-formed header assembly according to claim 3 wherein said pair of flanges of each of said first channel member, said second channel member, said third channel member, said fourth channel member, and said fifth channel member are each spaced apart to receive a respective end of a stud therebetween, and each comprise a height, with the respective end of the stud fixedly secured thereto.

5. The pre-formed header assembly according to claim 4 wherein said first channel member comprises a first channel section and a second channel section, said second channel section configured to slidably nested within said first channel section to adjust said length.

6. A pre-formed header assembly configured to be secured to a first king stud and a second king stud at respective king stud locations being selectively spaced apart for a particular door size and corresponding metal door frame, said pre-formed header assembly comprising:

a first channel having a length between a first end and a second end of said first channel;

a second channel configured to extend a distance between a first end and a second end of said second channel; a base of said second channel fixedly secured to a base of said first channel with said first end of said second channel positioned proximate to said first end of said first channel;

a third channel having a span between a first end and a second end of said third channel;

a base of said third channel fixedly secured to said base of said first channel with said second end of said third channel positioned proximate to said second end of said first channel;

a fourth channel, said fourth channel configured to extend from said first end of said first channel with a base of said fourth channel positioned substantially perpendicular to said base of said first channel, and with a pair of flanges of said fourth channel member configured for attachment to the first king stud;

a fifth channel, said fifth channel configured to extend from said second end of said first channel with a base of said fifth channel positioned substantially perpendicular to said base of said first channel, and with a pair of flanges of said fifth channel member configured for attachment to the second king stud;

wherein a gap between said base of said fourth channel and said base of said fifth channel is configured to mount said base of said fourth channel and said base of said fifth channel to the first king stud and the second king stud, respectively; and wherein a difference between said length, and the combination of said distance plus said span, is sized to receive a width of the metal door frame therebetween.

7. The pre-formed header assembly according to claim 6 wherein said distance is configured to provide a minimum spacing required to position the metal door frame in close proximity to an intersecting wall.

8. The pre-formed header assembly according to claim 6 wherein said span is configured to provide a minimum amount of space required for an electrical box.

9. A method of constructing a steel stud wall with a rough opening comprising:

securing a first king stud to an upper track and a lower track at a first selective distance away from a desired location for a first side of a metal door frame for a particular door size;

securing a second king stud to the upper track and the lower track at a second selective distance away from a second side of the desired metal door frame location;

forming a header comprising: forming a first channel member having a length configured to fit between said first and second king studs; forming a second channel member with a distance between its ends being substantially equal to said first selective distance, and securing a base of said second channel member to a base of said first channel member with a first end of said second channel member positioned proximate to a first end of said first channel member; forming a third channel member with a span between its ends being substantially equal to said second selective distance, and securing a base of said third channel member to said base of said first channel member with a second end of said third channel member positioned proximate to a second end of said first channel member; forming a fourth channel member, and securing a base of said fourth channel member to said base of said first channel member at said first end thereof, substantially perpendicular thereto; and forming a fifth channel member, and securing said fifth channel member to said second end of said first channel member with a base of said fifth channel substantially perpendicular to said base of said first channel; and securing said fourth channel member of said header to said first king stud and securing said fifth channel member to said second king stud, with said first channel member positioned at a height above the floor to provide a minimum clearance with a top of the metal door frame, for forming said rough opening.

10. The method according to claim 9 further comprising finishing said rough opening of the wall, said finishing comprising:

forming a first lower channel section having a lower channel length substantially equal to said first selective distance;

securing said first lower channel section to the floor, to have a first end thereof adjacent to said first king stud, and to extend toward a center of said rough opening;

forming a second lower channel section having a lower channel distance substantially equal to said second selective distance;

securing said second lower channel section to the floor, to extend from said second king stud toward the center of said rough opening;

securing a bottom end of a first jack stud to said first lower channel section and securing an upper end thereof to said second channel section, with said first jack stud adjacent to said first king stud;

securing a bottom end of a second jack stud to said second lower channel section and an upper end thereof to said third channel member, with said second jack stud positioned an extent away from a first end of said second lower channel equal to a width of said jack stud;

respectively securing third and fourth jack studs to first and second sides of a metal door frame; and installing said metal door frame with said third and fourth jack studs in said rough opening by:

receiving a top of said third jack stud in said second channel member, and receiving a top of said fourth jack stud in said third channel member;

receiving a bottom of said third jack stud in said first lower channel section, and receiving a bottom of said fourth jack stud in said second lower channel section;

fixedly securing said top and bottom of said third jack stud to said second channel member and said first channel section respectively; and fixedly securing said top and bottom of said fourth jack stud to said third channel member and said second channel section respectively.

* * * * *